US007805776B2

(12) United States Patent
Crossman et al.

(10) Patent No.: US 7,805,776 B2
(45) Date of Patent: Oct. 5, 2010

(54) FACE PROTECTOR AND PROTECTIVE SYSTEM

(75) Inventors: Daniel Crossman, Kanata (CA); Clint Alexander Hedge, Winchester (CA); Mark Smith, Nepean (CA); Justin Myles, Carlsbad Springs (CA)

(73) Assignee: Allen-Vanguard Technologies, Inc., Ottawa, Ontario (CA)

( * ) Notice: Subject to any disclaimer, the term of this patent is extended or adjusted under 35 U.S.C. 154(b) by 1134 days.

(21) Appl. No.: 11/425,598

(22) Filed: Jun. 21, 2006

(65) Prior Publication Data

US 2007/0083967 A1 Apr. 19, 2007

Related U.S. Application Data

(60) Provisional application No. 60/692,247, filed on Jun. 21, 2005, provisional application No. 60/774,230, filed on Feb. 17, 2006.

(51) Int. Cl.
*A42B 1/08* (2006.01)
*A42B 1/06* (2006.01)
*F41H 1/04* (2006.01)

(52) U.S. Cl. ..... 2/424; 2/410; 2/6.6

(58) Field of Classification Search ..... 2/410, 2/424, 6.6, 9, 6.1, 6.2
See application file for complete search history.

(56) References Cited

U.S. PATENT DOCUMENTS 4,042,974 A * 8/1977 Morgan et al. ..... 2/9
4,374,301 A 2/1983 Frieder, Jr. ..... 179/1 R
4,713,844 A 12/1987 Westgate ..... 2/411
5,078,130 A 1/1992 Van Oosten et al. .... 128/201.24
5,263,204 A * 11/1993 Butsch ..... 2/424
5,522,091 A 6/1996 Rudolf ..... 2/6.2
2006/0272067 A1 * 12/2006 Gagnon et al. ..... 2/9
2007/0000031 A1 * 1/2007 Makris et al. ..... 2/411

OTHER PUBLICATIONS http://www.cryeassociates.com/09.html; 2006.
http://www.gentexcorp.com/HelmetSystems/MFS/htm; 2006.

* cited by examiner

*Primary Examiner*—Gary L Welch
*Assistant Examiner*—Amber R Anderson
(74) *Attorney, Agent, or Firm*—Woodard, Emhardt, Moriarty, McNett & Henry LLP

(57) ABSTRACT

A face protector comprises a protective structure shaped for extending about a person's mandibular region and a mounting for mounting the face protector to a military combat helmet. The protective structure comprises a front portion and opposed left and right side portions extending from the front portion, the front portion having a free upper edge for positioning below eye level and above mouth level when mounted to the helmet, and being size to extend to below a person's chin. The front portion has inner and outer surfaces, and the mounting is positioned to space the inner surface and the upper edge away from the person's mouth and nose when mounted to the helmet to provide a gap for the passage of ambient air therebetween to permit unobstructed breathing. The protective structure comprises a ballistic resistant material for providing protection against high velocity fragments from explosive devices.

13 Claims, 30 Drawing Sheets

FACE PROTECTOR AND PROTECTIVE SYSTEM

CROSS-REFERENCE TO RELATED APPLICATIONS

This non-provisional application claims priority from U.S. Provisional Patent Application No. 60/692,247 filed Jun. 21, 2005 and U.S. Provisional Patent Application No. 60/774,230 filed Feb. 17, 2006, all of which are incorporated herein by reference.

FIELD OF THE INVENTION

The present invention relates to protective equipment, and in particular to face protectors.

BACKGROUND OF THE INVENTION

Head protectors such as helmets may incorporate a fixed or movable transparent visor for protecting a person's eyes from the environment. Another form of protective equipment are face masks which fit over the nose and mouth of a user and seal to the user's face to protect the user from breathing noxious gases, and which are provided with a filter to filter environmental air or a supply of clean air from another source. An example of such a face mask is disclosed in U.S. Pat. No. 4,374,301. The face mask encloses the wearer's nose and mouth and provides a seal with the wearer's face. The mask includes an oxygen inlet coupled by a hose to a connector which releasably attaches to a receptacle on a helmet assembly. The opposite side of the mask can be secured to the helmet assembly by means of a strap.

Another example of a face mask for use with a helmet is described in U.S. Pat. No. 4,713,844. The face mask includes a frame which is shaped to register with the peripheral edge of an open face helmet and includes a peripheral face seal for sealing about a wearer's face. The face mask includes an upper ocular cavity having a pair of lenses and a lower oral-nasal cavity, both within the peripheral seal and which are divided by a partition. Each side of the mask has a bayonet fastener for fastening the mask to the helmet.

Another example of a helmet and face mask is disclosed in U.S. Pat. No. 5,078,130. The face mask is rotatably mounted to the helmet so that it can be moved between lowered and raised positions, and the mounting also enables the face mask to be slidably moved towards and away from a wearer's face in the lowered position. The face mask includes an internal seal which forms an oral-nasal cavity between the nose and chin of a wearer. A coupling mechanism is provided for coupling the face mask to a clean air supply. When in the lowered position, the face mask can be selectively moved between a position away from a wearer's face where the seal is broken so that the wearer can breathe ambient air, and a position in which the seal seals the face mask to a wearer's face to isolate the oral-nasal cavity from ambient air. The face mask includes an integrated window above the oral-nasal cavity.

Other forms of known protective equipment include transparent protective eyewear which generally have some retention system, for example a strap for retaining the eyewear on the head of a user.

SUMMARY OF THE INVENTION

According to the present invention, there is provided a face protector comprising a protective structure shaped for extending about a person's mandibular region, a mounting for mounting the face protector to a helmet, the protective structure comprising a front portion and opposed left and right side portions extending from said front portion, said front portion having a free upper edge for positioning at a position below eye level and above mouth level and being sized to extend from said position to below a person's chin, wherein said front portion has an inner surface and an outer surface, and said mounting is positioned to space said inner surface and said upper edge away from a person's mouth and nose when mounted to a helmet to provide a gap for the passage of ambient air therebetween to permit unobstructed breathing.

Advantageously, the face protector provides protection for the lower face region of a user without obstructing vision, breathing or the ability to communicate orally, and without reducing spatial awareness. In some embodiments, the face protector is adapted for mounting to a standard military helmet to increase head protection, and in some embodiments provides ballistic protection against high velocity fragments, for example, from improvised explosive devices (IEDs) such as road side bombs or other explosive devices.

In some embodiments, the left and right side portions each have a free upper edge for positioning at a position below eye level and above mouth level when mounted to a helmet, and are sized to extend to a position substantially at or below jaw level. Advantageously, the side portions protect a substantial portion of the sides of a user's face, while not interfering with a person's vision or spatial awareness.

The left and right side portions and/or the front portion may generally comprise a web of material. The web may be substantially continuous, i.e. without perforations or holes, or may include perforations or holes, if desirable or required.

In some embodiments, the side portions are shaped and sized to cover a person's mandibular region, when in use, the side portions including an upright region which, in use, covers a rear mandibular region, and which extends between upper and lower parts of the side portion, and whose outer surface is generally directed in the same direction as a person's rear mandibular region. Thus, in this arrangement, the outer surface of the rear side portions of the face protector generally has the same profile as the corresponding portion of a person's face, and the side portions may be spaced apart to provide a relatively close fit to a person's face in this region. Advantageously, this reduces or minimizes interference between the face protector and a shoulder mounted device such as a gun or rifle. In some embodiments, the distance between the outer surface of the upright region of the left and right side portions is between 0.3 and 2 centimeters from a user's face, when the face protector is in use.

In some embodiments, the face protector comprises an outwardly extending portion extending from one or both of the side portions for enabling the face protector to be mounted to the helmet. The outwardly extending portion may extend from an upper part of the side portion, for example at a position which substantially corresponds to the vertical position of a lower edge of a front side portion of a helmet for which the face protector is adapted to be used. This increases the vertical dimension of the recess or scalloped region formed between the side portions of the face protector and the outwardly extending portions to reduce or minimize interference with a shoulder mounted device.

In some embodiments, the face protector further comprises a flange extending upwardly from the outwardly extending portion for positioning and overlapping a portion of a helmet, when in use. Advantageously, the flange facilitates mounting the face protector to the helmet and may carry a fastener for releasably securing the face protector to the helmet.

In some embodiments, the outwardly extending portion forms a seat for seating against a lower edge of a helmet, or bracket mounted to the helmet.

In some embodiments, the face protector comprises a ballistic resistant material or structure to protect against high velocity projectiles such as bullets and shrapnel. The ballistic resistant material may comprise one or more layers of aramid material such as Kevlar, Dyneema, Spectra or other high tensile strength material and may be formed as a rigid or semi-rigid structure. For example, the face protector may be formed from one or more layers of resin impregnated fabric and formed in a mold by pressure and/or heat treatment.

In some embodiments, one or more portions of the face protector may comprise a resilient or soft material and may be treated to provide a level of protection against ballistic objects. For example, the face protector may include one or more regions formed of a flexible compound which is impregnated with ballistic resistant material such as an aramid based material. The face protector may include a softer region in an area which lies adjacent to a shoulder mounted weapon such as a rifle to facilitate resting the face protector against the weapon or other shoulder mounted device. A lower portion of the face protector may be scalloped or recessed to enable a wearer to lean his/her head to the left or right to be able to align their eye with the sights of the rifle without the rifle butt or other rifle components interfering with the face protector.

The face protector may be restricted to a person's mandibular region so that it mainly covers the lower jaw area and has an upper edge which, with the helmet, defines an opening for a person's face.

Also according to the present invention, there is provided a protective system comprising a helmet having a front and a back, and a face protector for mounting on said helmet and for extending from said helmet towards the front thereof, and comprising a protective portion for extending about a person's mandibular (lower jaw) region, said protective portion comprising a protective structure, said face protector being sized to provide a gap between a front portion thereof and a user's face, when mounted to said helmet, and having a free upper peripheral edge positioned below eye level, when in use, which with said helmet defines a frontal opening between said peripheral edge and a lower front edge of said helmet.

In some embodiments, the face protector includes left and right side portions and a front portion, and one or more of said side portions and said front portion comprises a ballistic resistant material or structure. The ballistic resistant material may comprise for example a high tensile strength fabric such as an aramid based material or other high tensile strength material.

In some embodiments, one or more of the front portion and opposed side portions comprises a relatively rigid or semi-rigid structure.

In some embodiments, the front portion and/or one or more of the side portions comprises a composite material.

In some embodiments, the front portion has a lower edge which extends below a lower edge of at least one side portion. The lower extension of the front portion may provide additional protection to the throat and neck region.

In some embodiments, the opposed side portions have upper and lower portions and a lower portion of the side portion is directed or curved inwardly.

In some embodiments, the face protector has a lower peripheral edge which extends about the lower mandibular region and has the form of a "U" or horseshoe and is sized to provide a gap between the lower peripheral edge and the lower jaw of a user, when in use. In some embodiments, the lower front and side portions of the face protector are spaced apart from a person's lower jaw, when in use, so as not to interfere with movement of the jaw between lowered and raised positions, to allow natural opening and closing of a person's mouth, for example during speech.

In some embodiments, the helmet shell comprises a combat helmet for military use.

In some embodiments, the protective helmet system further comprises mounting means for enabling the face protector to be detachably mounted to the helmet. In some embodiments, the mounting means may comprise a left part and a right part each mounted to respective sides of the helmet, and complementary parts mounted on each side of the face protector.

In some embodiments, the mounting means comprises a slideable mounting to enable the face protector to be slideably mounted to the helmet. The slideable mounting may be oriented to enable the face protector to be slideably moved in a direction extending between the front and the back of the helmet. Advantageously, this allows the position of the face protector relative to the helmet to be adjusted so that the face protector can be moved away and towards a wearer's face and its relative proximity to the wearer's face adjusted, depending on the wearer, and also to allow more space between the wearer's face and the face protector for accommodating additional equipment that a wearer might be wearing, such as a respirator or other equipment.

The protective helmet system may comprise locking means to enable the face protector to be locked in position relative to the helmet. The locking means may be adapted to enable the face protector to be locked relative to the helmet in a plurality of different positions, for example so that the front of the face protector can be locked at different distances from the helmet.

In some embodiments, the mounting means comprises a first part and a second part, wherein the second part defines a channel for receiving the first part. The first part may include side edges for engaging corresponding side edges of the channel, and at least one of the side edges of the channel and the first part are formed to prevent the first part from being withdrawn from the opening of the channel between the ends thereof. The first part may comprise a first portion which faces the base of the channel, and at least one of the side edges of the first part slopes outwardly towards the first portion. The outwardly sloping part essentially prevents the first part from being withdrawn from the longitudinal opening of the channel between its ends.

The first part may comprise one or more transverse grooves to provide a means for locking the channel part in position. The channel part may comprise a part which is received within the groove(s) to act as a locking member.

In one embodiment, the slideable mounting may comprise a picatinny type mounting, which is normally used for mounting components to rifles.

In some embodiments, the face protector further includes mounting means for mounting a device thereto. The mounting means may comprise a corresponding mounting corresponding to a mounting provided on the helmet for mounting the face protector thereto, such that the device can be mounted either directly to the helmet using the mounting for the face protector or mounted directly to the face protector using the corresponding mounting.

The device may comprise any one of a light source, an optical device such as a monocular device, glasses or goggles.

In some embodiments, the protective helmet system further comprises a helmet mounting for attachment directly to the helmet and which is adapted to support a mounting part for mounting the face protector to the helmet. The helmet mounting may be mounted to the helmet using the same through holes used to mount a helmet retention system to the helmet, or any other existing through holes. Advantageously, the helmet mounting enables the face protector mounting part to be mounted to different helmets without the need for making special holes in the helmet. Rather, the helmet mounting preferably uses existing attachment means, such as through holes, which may be positioned differently for different helmets. In this case, the helmet mounting is adapted to fasten to existing anchor points on the helmet, by, for example, forming holes therein at corresponding locations, as required. The helmet mounting may comprise a plate or strip of formable material such as any metal material or composite material, plastics material such as polycarbonate or any other suitable material. The plate or strip may comprise a band which extends about at least a portion of the circumference of the helmet and is secured thereto at mounting points which are preformed in the helmet, for example, for mounting the helmet retention system.

According to the present invention, there is further provided a protective system comprising a helmet shell having a front and a back, and a face protector extending from said helmet towards the front thereof, and comprising a protective portion for extending about a person's mandibular (lower jaw) region, said protective portion comprising a protective structure.

According to another aspect of the present invention, there is provided a face protector for mounting to a helmet having any one or more of the features described above.

According to another aspect of the present invention, there is provided a face protector comprising a front portion and opposed side portions extending from said front portion.

BRIEF DESCRIPTION OF THE DRAWINGS

Examples of embodiments of the present invention will now be described with reference to the drawings, in which.

DESCRIPTION OF EMBODIMENTS

Figure 1:
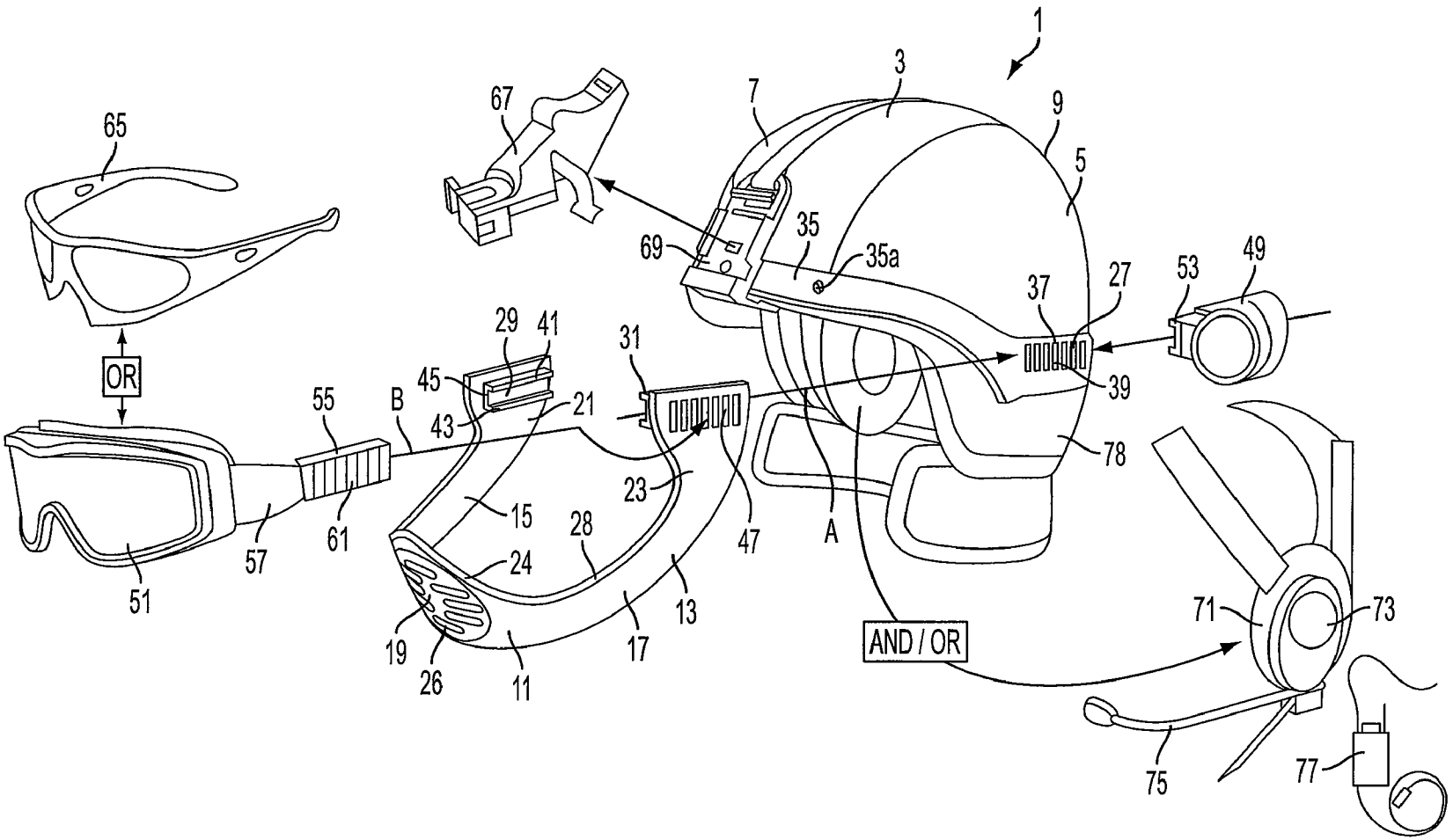
FIG. 1 shows an exploded view of the helmet system according to an embodiment of the present invention.
Figure 2:
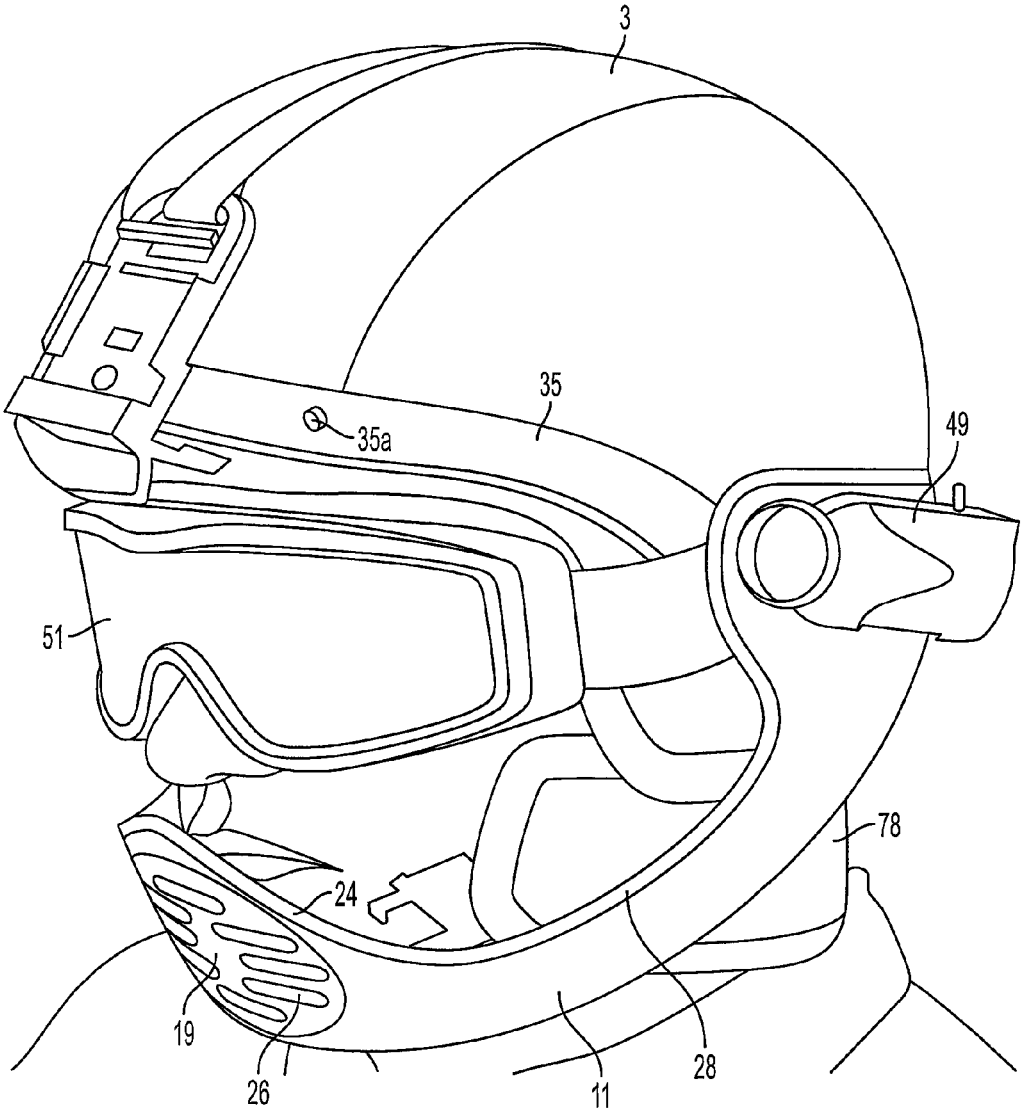
FIG. 2 shows a helmet system as shown in FIG. 1 in the assembled condition.

FIGS. 1 and 2 show a helmet system according to an embodiment of the present invention. The helmet system 1 comprises a helmet 3 comprising a helmet shell 5 having a front 7 and a back 9. The helmet system 1 further comprises a face protector 11 comprising a protective portion for extending about a person's mandibular (lower jaw) region and which comprises a protective structure. The protective portion 13 comprises right and left side portions 15, 17 for covering and protecting the right and left sides of a person's jaw, respectively, and a front portion 19 extending from the side portions for covering and protecting a person's lower front face region, such as the chin and/or mouth regions, as, for example, shown in FIG. 2. The face protector further includes right and left upper side portions 21, 23 for enabling the face protector to be mounted to the helmet 3. In this embodiment, the upper side portions 21, 23 of the face protector enable the face protector to be mounted at positions either side of the helmet in the temple region and/or above the position of a person's ears. Advantageously, this mounting position enables the face protector to be mounted to a military combat helmet which is open face and has a relatively low profile or draft.

The front portion 19 has an inner surface facing the mouth of the wearer, and an upper peripheral edge 24. The face protector is so shaped and sized as to provide a gap between the face of a user and the inner surface and upper peripheral edge 24 of the front portion to permit unobstructed breathing and oral communication. The upper peripheral edge 24 is also below eye level to provide unobstructed vision. In this embodiment, the middle part of the front portion is raised above parts adjacent and either side thereof to provide enhanced coverage of the mouth region, and may extend upwardly to cover at least a portion of the nasal region. Optional hole(s) or perforation(s) 26 may be provided in the front portion for increased ventilation, if required.

The right and left side portions also have an upper peripheral edge which is positioned below eye level so as not to obstruct the peripheral vision of a user and to preserve spatial awareness.

In some embodiments, the face protector may be permanently mounted to the helmet shell. However, in other embodiments, it may be beneficial to allow the face protector to be detachably mounted to the helmet, and the helmet system may include mounting means for detachably mounting the face protector to the helmet.

In the embodiment of FIG. 1, a mounting system is provided for detachably mounting the face protector and/or other devices to the helmet. The mounting system comprises right and left mounting parts 25, 27 which are secured to and carried by the helmet, and left and right complementary mounting parts 29, 31 secured to and carried by respective left and right side portions 21, 23 of the face protector. The mounting system is adapted to enable the face protector to be slideably mounted to the helmet by sliding the complementary mounting parts onto the helmet mounting parts in a direction which extends between the front and back of the helmet. The mounting system is further adapted to allow the relative position of the face protector, when attached to the helmet, to be varied by sliding the face protector back and forth towards and away from the helmet, thereby enabling the face protector to be moved away from and towards a wearer's face to suit the individual person. Advantageously, this also enables the helmet system to accommodate devices placed on or at the front of a person's face, such as masks, respirators, insulation and other material or devices.

In the embodiment shown in FIG. 1, the mounting system further comprises a support or bracket 35 for supporting the helmet mounting parts 25, 27. Advantageously, the support enables the mounting parts 25, 27 to be indirectly mounted to the helmet to obviate the need to make additional holes in the helmet for mounting the left and right helmet mounting parts. In this embodiment, the support 35 comprises a strip of formable material which extends over the outer surface of the helmet and is secured to the helmet using one or more fasteners which fasten through existing helmet holes, for example, those used to secure a retention system to the inside of the helmet. The support 35 may comprise any suitable material, for example, a metal such as aluminum, a plastics material such as polycarbonate or other polymeric material. In this embodiment, the support is secured to the helmet using one or more fasteners 35*a* such as a screw, bolt or rivet at the front of the helmet, and at one or more positions at the rear of the helmet.

In the embodiment shown in FIG. 1, the left and right helmet mounting parts 25, 27 comprise elongate members in the form of a bar having opposed longitudinal side edges 37,39. The complementary mounting parts 29, 31, carried by the face protector comprise members in the form of a channel having opposed side walls 41, 43 which engage with and slide relative to the longitudinal side walls 37, 39 of the helmet mounting parts 25, 27.

The helmet system may include locking means for locking the position of the face protector relative to the helmet, and conveniently, these may be provided by the mounting parts 25, 27, 29, 31. In one embodiment, the mounting parts 25, 27 include bar members 25*a*, 27*a* and may comprise one or more grooves or other recesses for receiving a locking member mounted on the complementary parts 29, 31.

In other embodiments, it will be appreciated that one or both of the helmet mounting parts and face protector mounting parts could be reversed so that, for example, one or both bar members are mounted on the face protector and the channel member(s) are mounted on the helmet.

In the embodiment of FIG. 1, the channel parts are mounted to the inside of the upper side portions of the face protector. The other side, i.e. the outside surface of the upper side portions 21, 23 of the face protector may be provided with additional mounting parts 45, 47 for mounting objects thereto, such as one or more light sources 49 and/or a pair of goggles 51.

In this embodiment, the additional mounting parts 45, 47 are similar to the helmet mounting parts 25, 27. Thus, by using the same mounting system, the other devices or objects can be either mounted directly to the helmet, without the face protector or mounted to the helmet system with the face protector in place. In the embodiment of FIG. 1, a light source 49 (for example a flashlight) is provided with a channel-type mounting part 53 which allows the light source 49 to be either directly mounted to the helmet using the bar mountings 25, 27 or mounted indirectly to the helmet using the bar mountings 45, 47 on the face protector when the combination of the face protector and light source is required.

A pair of goggles 51 also includes channel type mounting parts 55, for example attached to a side strap 57 of the goggles 51 and which can either be directly attached to the helmet using helmet mounting parts 25, 27 or, if the face protector is also used, the goggles can be connected to the external mounting parts 45, 47 of the face protector.

In another embodiment, the goggles 51 or other optical device may further include a mounting part for mounting objects thereto, and in one embodiment, the mounting part may be similar to the mounting parts 25, 27 attached to the helmet, and additional mounting parts 45, 47 attached to the face protector. Advantageously, this arrangement allows three devices to be attached to the helmet, for example, the face protector, a pair of goggles 51 and a light source 49. In this case, the face protector may be directly attached to the helmet using helmet mounting parts 25, 27 and complementary channel parts 29, 31 on the face protector, as indicated by arrow A. The pair of goggles 51 may be attached directly to the face protector using the additional mounting parts 45, 47 on the face protector and the internal mounting parts 53, 55 on the goggles, as indicated by arrow B. The light source may be attached directly to the goggles 51 using the additional goggle mounting parts 59, 61.

Advantageously, this mounting system allows the various modular components of the helmet system to be configured in a variety of different ways, to suit the particular application and threat level.

The helmet system may optionally include a pair of protective glasses 65 and/or an optical device 67 such as a monocular device 67, which may be mounted to the front of the helmet on a suitable mounting 69. The helmet system may include an auditory device 71 such as headphones 73 and/or one or more microphones 75 powered by a suitable power source 77.

In other embodiments, a monocular device may be mounted to the side of the helmet using one of the mounting systems described above, for example, the helmet mounting parts 25, 27, the additional mounting parts 45, 47 on the face guard or the additional mounting parts 59, 61 on the goggles 51. The helmet system may further comprise a neck protector 78 for protecting the sides and/or back of a person's neck, and may comprise one or more layers of ballistic resistant material, such as an aramid fibre-based material, or other material. Examples of embodiments of different neck protectors are described in the applicant's U.S. Provisional Patent Application No. 60/663,197, the entire contents of which is incorporated herein by reference.

An example of a configuration of a helmet system as worn by a person is shown in FIG. 2. In this configuration, the face protector 11, a pair of goggles 51 and an optical device 49 are all mounted to the helmet 3. The goggles are mounted directly to the helmet and the face protector 11 is mounted indirectly to the helmet using the additional mounting parts 61 of the goggles 51, shown in FIG. 1.

Figure 3A:
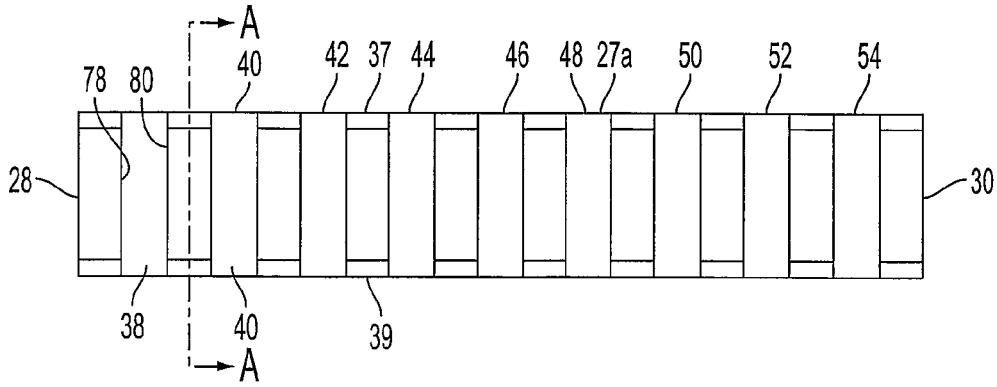
FIG. 3A shows a top view of a mounting member according to an embodiment of the present invention.
Figure 3B:
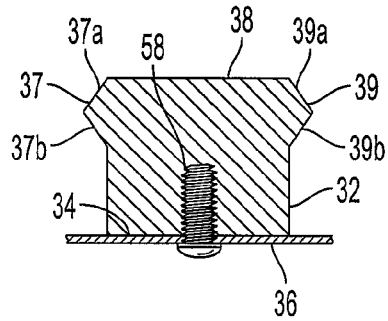
FIG. 3B shows a transverse cross-sectional view through the mounting member shown in FIG. 3A along the lines A-A.

An embodiment of a mounting system is described in more detail below with reference to FIGS. 3A, 3B, 4A and 4B. Referring to FIGS. 3A and 3B, one part of the mounting system comprises a longitudinal bar member 27*a* having opposed ends 28, 30 and opposed longitudinal side edges 37, 39. The bar member 27*a* has a lower support portion 32 having a lower support surface 34 for mounting to a suitable substrate 36, for example, the mounting support 35 shown in FIGS. 1 and 2. The bar member 27*a* has an upper surface 38. A plurality of transverse grooves 40, 42, 44, 46, 48, 50, 52 and 54 are formed at spaced intervals along the bar in the upper surface thereof to provide locking recesses so that the complementary member may be locked to the bar member 27*a* at a plurality of different positions.

Each side edge 37, 39 of the bar member 27*a* has a convex profile as shown in the cross-sectional view of FIG. 3B. In this embodiment, the upper portion of the side edges 37*a*, 39*a* taper outwards towards to the base and are generally linear. The lower portion of the side edges 37*b*, 39*b* taper in the opposite direction and are generally linear. However, in other embodiments, the profile may be non-linear, for example, curved. The bar member 27*a* may be secured to a mounting substrate 36 by any suitable means, for example, by means of a screw 58, adhesive or any other suitable means or device.

Figure 4A:
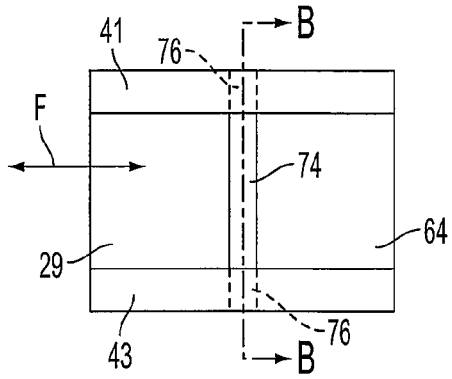
FIG. 4A shows a plan view of a channel mounting member according to an embodiment of the present invention.
Figure 4B:
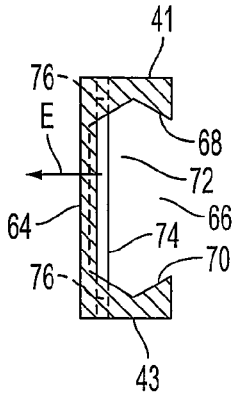
FIG. 4B shows a transverse cross-sectional view through the channel member shown in FIG. 4A along the lines B-B.

Referring to FIGS. 4A and 4B, the complementary connecting member 29 is in the form of a channel having opposed channel walls 41, 43 and a base 64 extending between the channel walls 41, 43. Opposite the base 64, the channel walls define a channel opening 66.

The interior surface 68, 70 of the channel walls 41, 43 which face the channel 72 are generally convex in cross section to complement the concave shape of the upper part of the bar member 27*a* shown in FIGS. 3A and 3B. In this embodiment, the interior surface of the channel walls 68, 70 initially taper outwardly from the opening 66 towards the channel base, and thereafter taper inwardly as shown in FIG. 4B.

The mounting members 27, 29 are connected together by positioning the members end to end so that the opening of the channel 68 is facing the upper surface 38 of the bar member and the channel member is slid longitudinally over the bar member so that the upper part of the bar member is received longitudinally within the channel.

A locking member may be provided to lock the channel member to the bar member, and in one embodiment, the locking member comprises a transverse member 74. The transverse member may be secured between the channel walls and may be inserted through a transverse aperture 76 formed in one or both channel walls. The locking member 74 may comprise a rigid member, in which case, it may be necessary to remove or withdraw the locking member 74 from the channel to enable the mounting members to be connected/disconnected. In another embodiment, the locking member may comprise a resilient member which can flex towards the base of the channel as indicated by the direction of arrow E in FIG. 4B so that the locking member moves out of the grooves in the bar member when a sufficient longitudinal force is applied to the channel member relative to the bar member as indicated by the direction of arrow F in FIG. 4A. To facilitate the resilient locking member flexing out of a groove in the bar member, one or both opposite sides of the groove 78, 80 in FIG. 3A, for example, may be tapered outwardly in a direction towards the upper surface of the bar so that a longitudinally directed force between the channel member and bar member provides a component force in the direction E in FIG. 4B.

It will be appreciated that the bar member and channel member may be provided with any suitable engaging surfaces to hold the channel member on the bar member to prevent the bar member from being withdrawn from the channel member through the channel opening 66 by applying a relative force in the direction of arrow E shown in FIG. 4B. For example, in another embodiment, the lower inwardly tapering surface of the channel may be omitted so that the interior surface of the channel comprises the outward tapering surfaces only adjacent the channel opening 66. Alternatively, the interior surface of the channel walls may extend at 90° from the base and one or both sides of the channel walls may include a flange which extends inwardly to define the channel opening 66, the flange engaging a portion of the bar member to prevent the bar member being withdrawn through the channel opening.

The mounting system described above is similar to a picatinny mounting system used on rifles.

Figure 5:
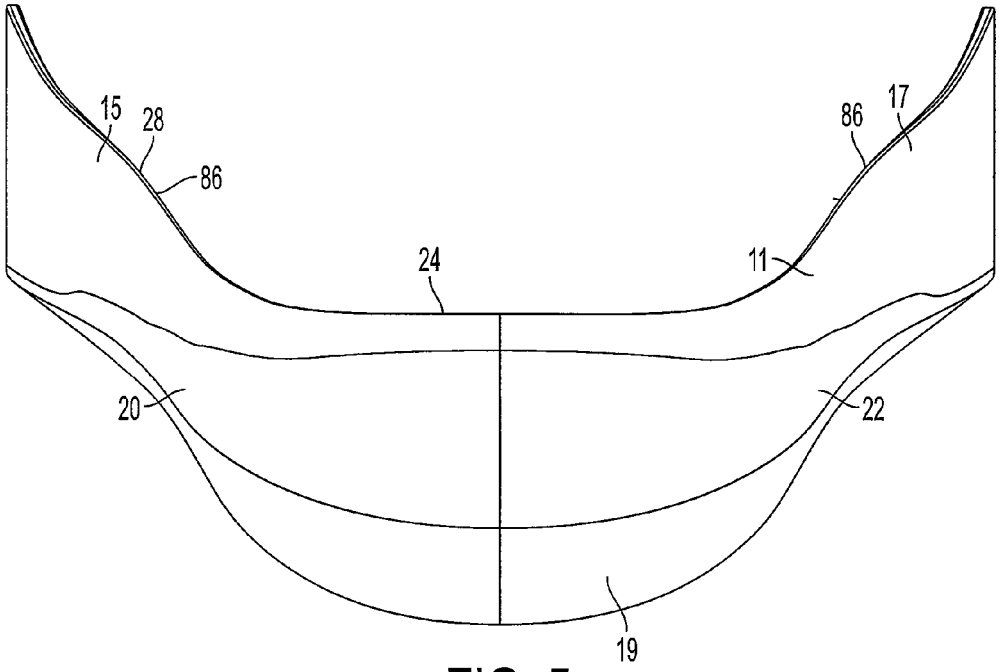
FIG. 5 shows a front view of a face protector according to an embodiment of the present invention.
Figure 6:
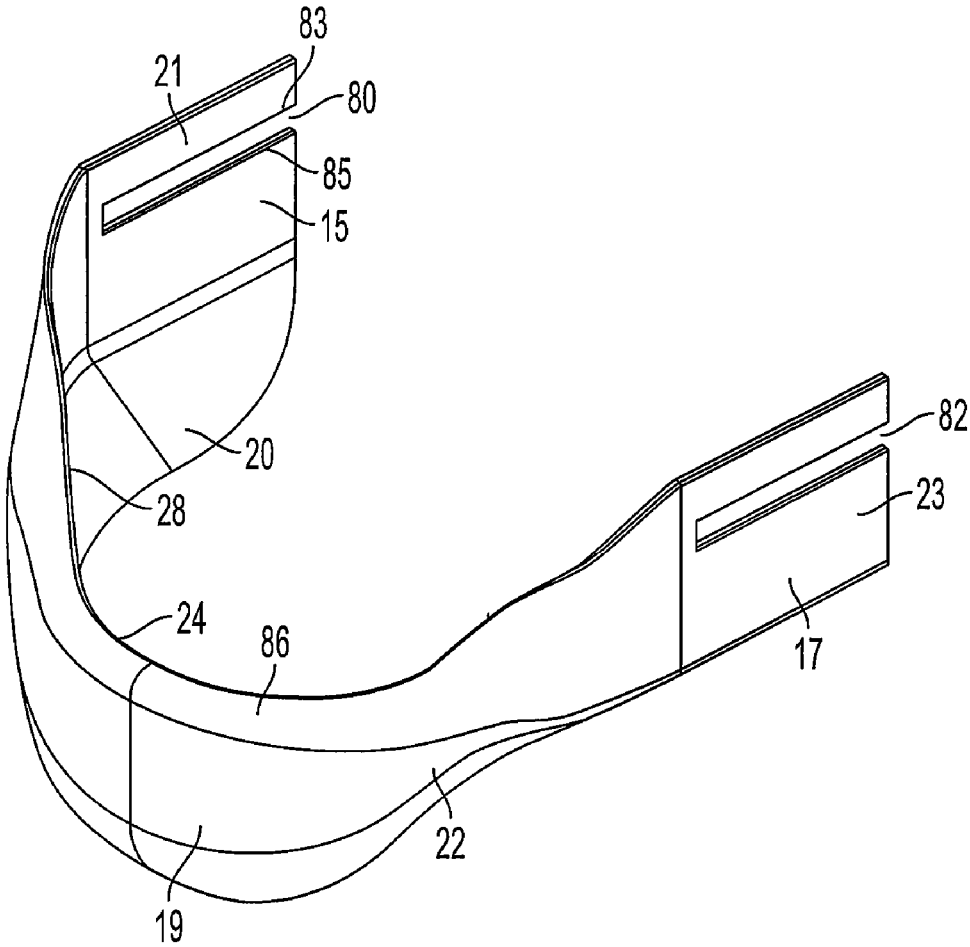
FIG. 6 shows a front and left side perspective view of a face protector shown in FIG. 5.
Figure 7:
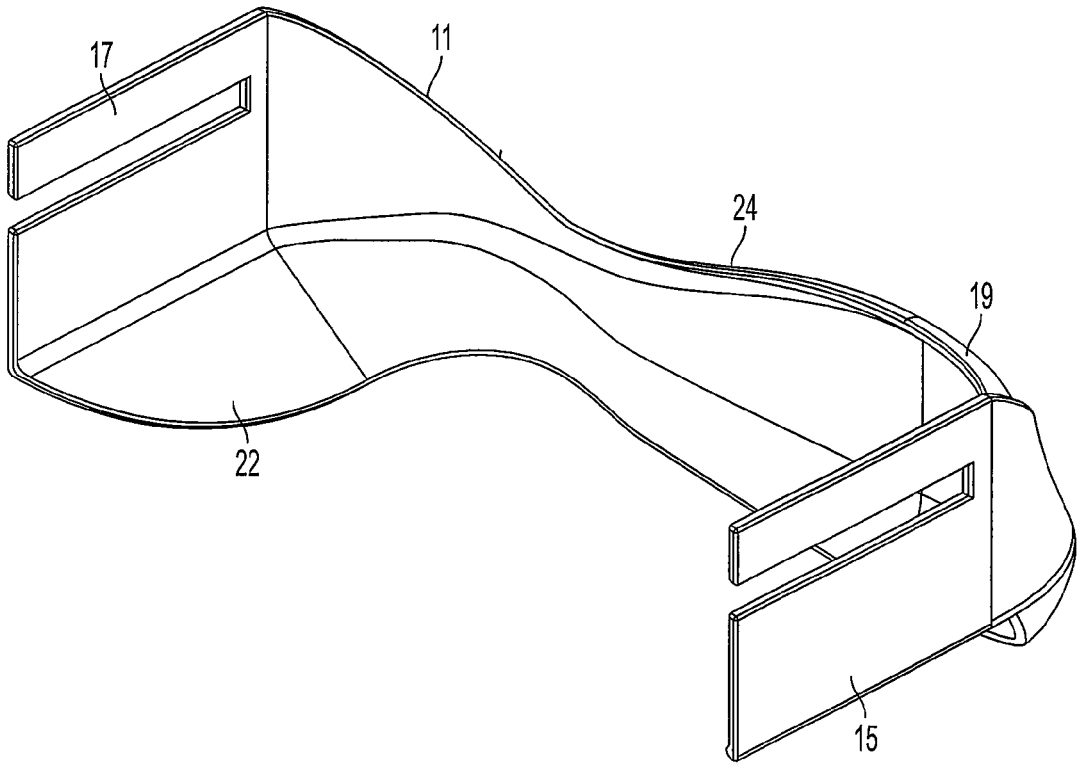
FIG. 7 shows a rear and right side perspective view of the face protector shown in FIGS. 5 and 6.

FIGS. 5 to 7 show a face protector according to an embodiment of the present invention. Referring to FIGS. 5 to 7, the face protector 11 comprises right and left side portions 15, 17 and a front portion 19. The side portions are generally designed to cover a person's lower jaw region, and the front portion 19 is shaped and sized to cover a person's chin, and possibly mouth region, and may extend to also cover at least a portion of a person's nose. The front and side portions have a free upper edge 24,which, when the face protector is mounted to a helmet are positioned below eye level so as not to interfere with a person's vision or spatial awareness. The upper peripheral edge and inner surface of the front portion is spaced apart from a user's face to allow unobstructed breathing and oral communication.

The lower part 20, 22 of the right and left side portions are scalloped, as best shown in FIG. 5, to reduce interference between the face protector and a shoulder mounted device such as a rifle or other weapon. Advantageously, the scalloped regions allow a person to tilt his/her head towards a rifle so that the user can look along the rifle sights. The scalloped regions and/or other regions of the face protector may comprise a resilient or relatively soft material at least on the outer surface thereof to provide cushioning between the face protector and the rifle or other shoulder mounted device. The soft material may comprise a rubber based compound such as butyl rubber, possibly impregnated with a ballistic resistant material. In other embodiments, the soft region may be provided by a gel-type material.

Referring to FIGS. 6 and 7, the upper side portions 21, 23 of the face protector include slots 80, 82 formed therein for providing a slideable mounting to the sides of a helmet. In this case, the bar mounting 25, 27 described above can be modified with longitudinal slots in the support section to receive the flanges 83, 85 either side of the slots 80, 82 on the face protector. Alternatively, the sides of the face protector shown in FIGS. 5 to 7 may be provided with a mounting as described above, such as a channel part or bar part for mounting to the helmet. The face protector has an upper edge 86 which defines a face opening, when mounted to the helmet.

Figure 8:
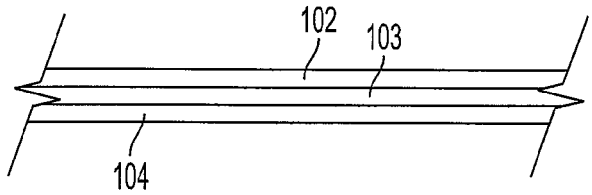
FIG. 8 shows a cross-sectional view through a structure of the face protector according to an embodiment of the present invention.
Figure 9:
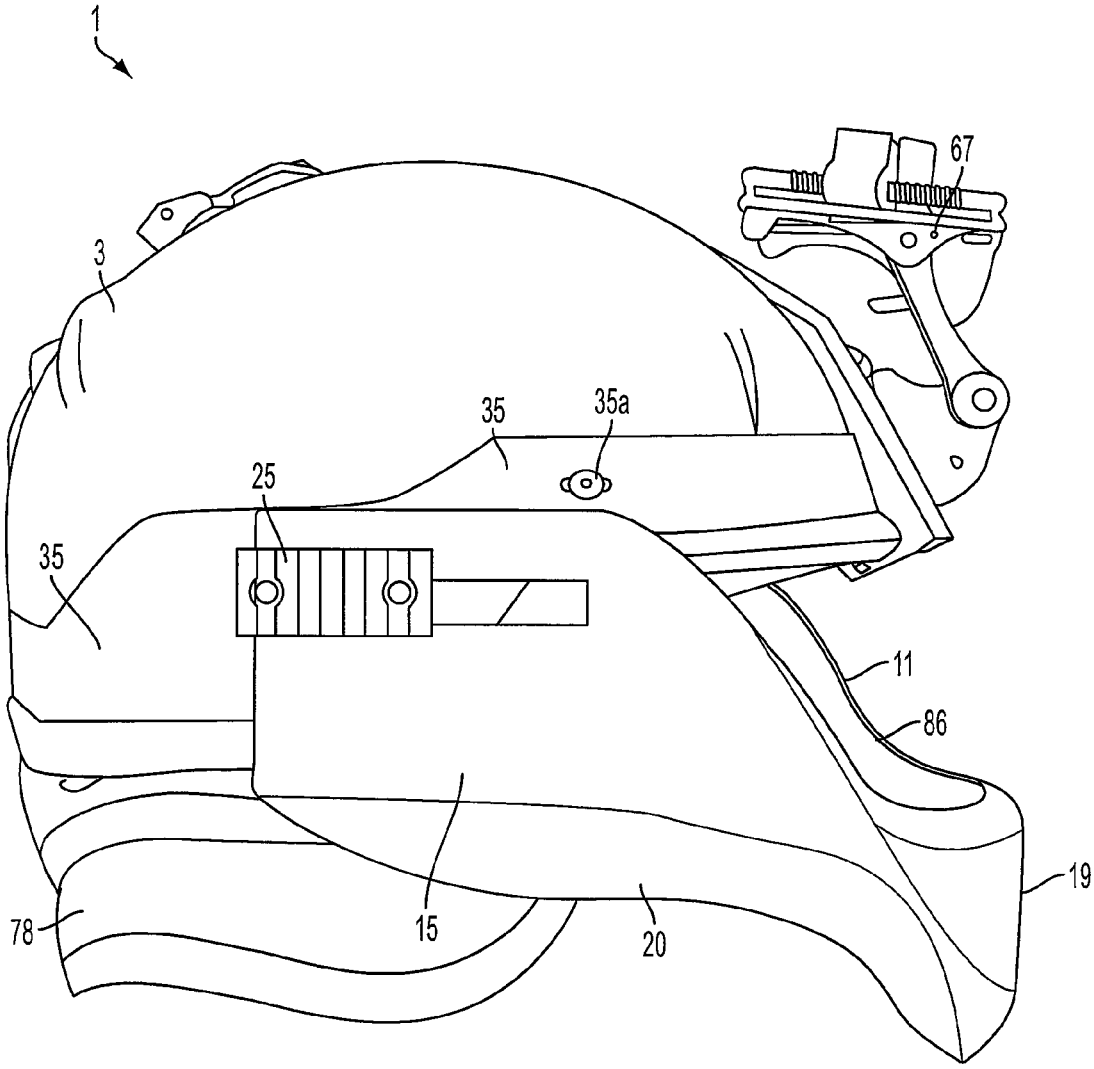
FIG. 9 shows a right side view of a helmet system according to an embodiment of the present invention.
Figure 10:
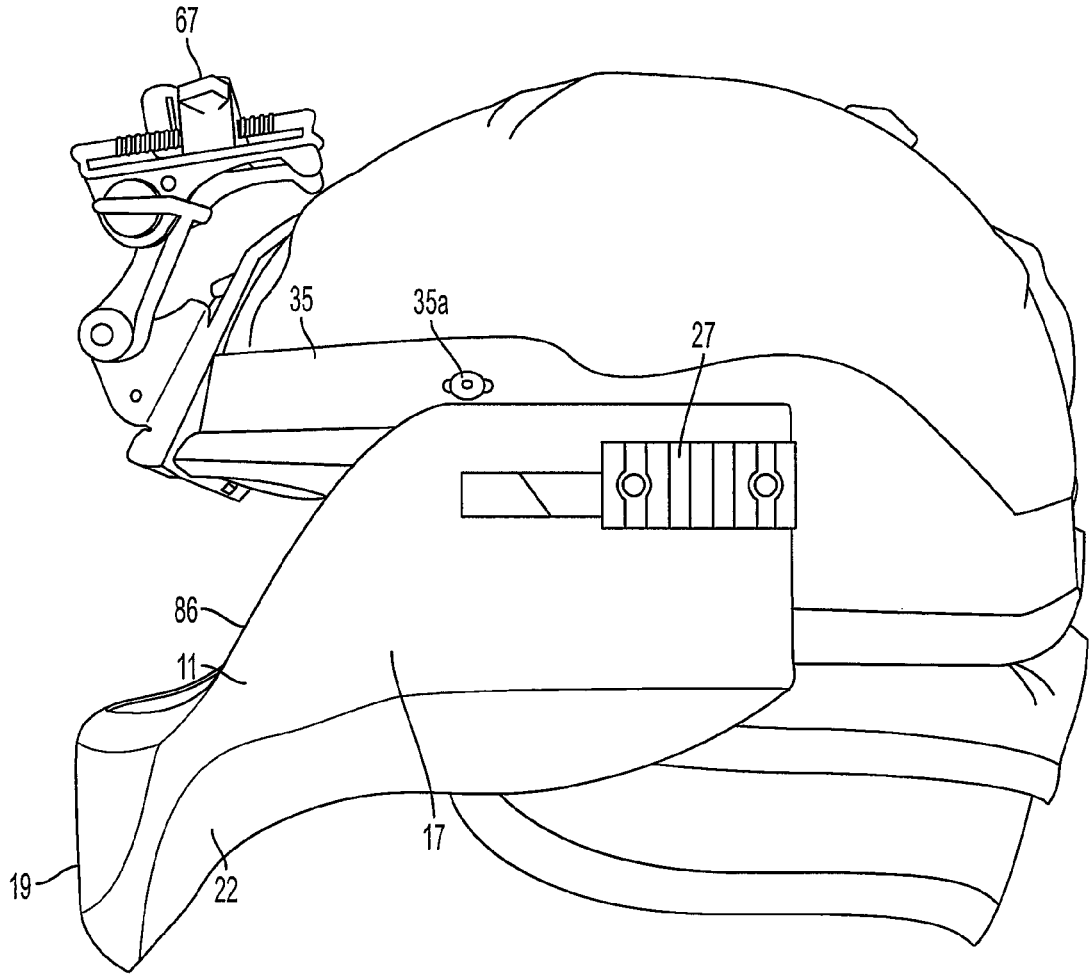
FIG. 10 shows a left side view of a helmet system according to an embodiment of the present invention.
Figure 11:
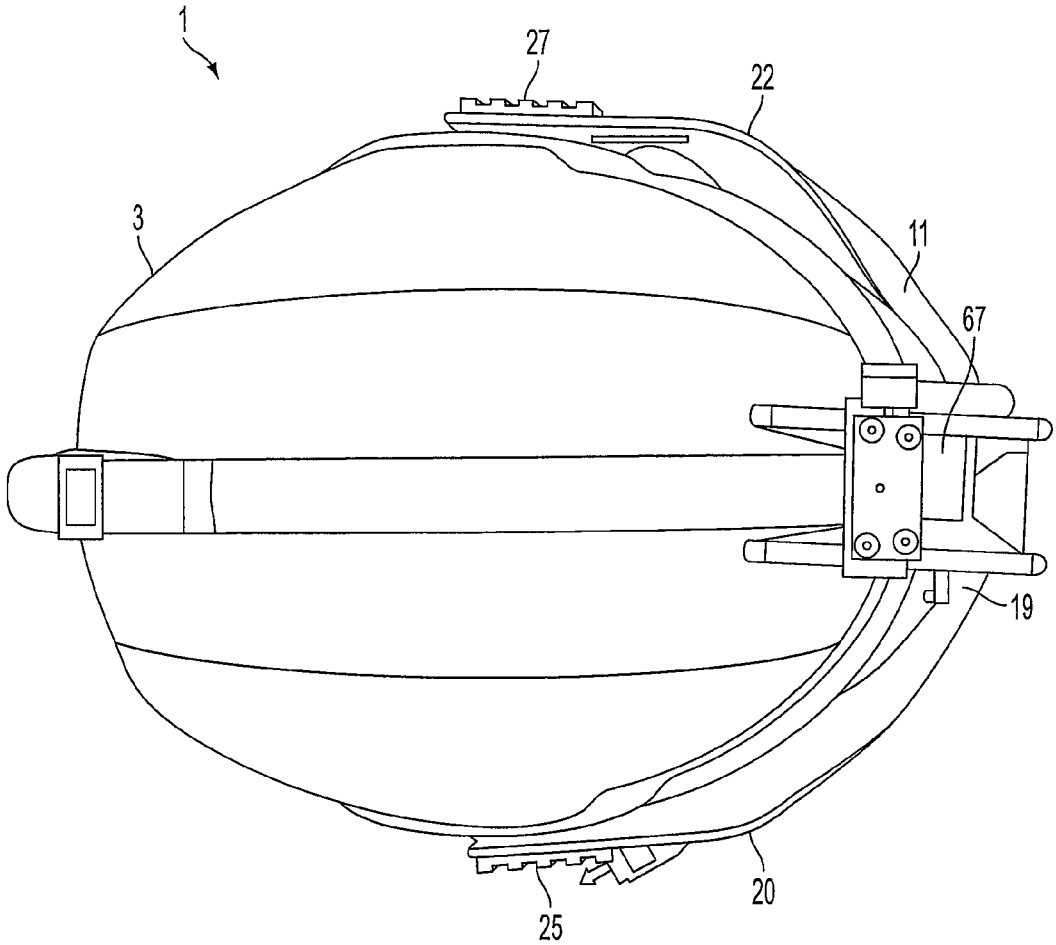
FIG. 11 shows a top view of the helmet system shown in FIGS. 9 and 10.
Figure 12:
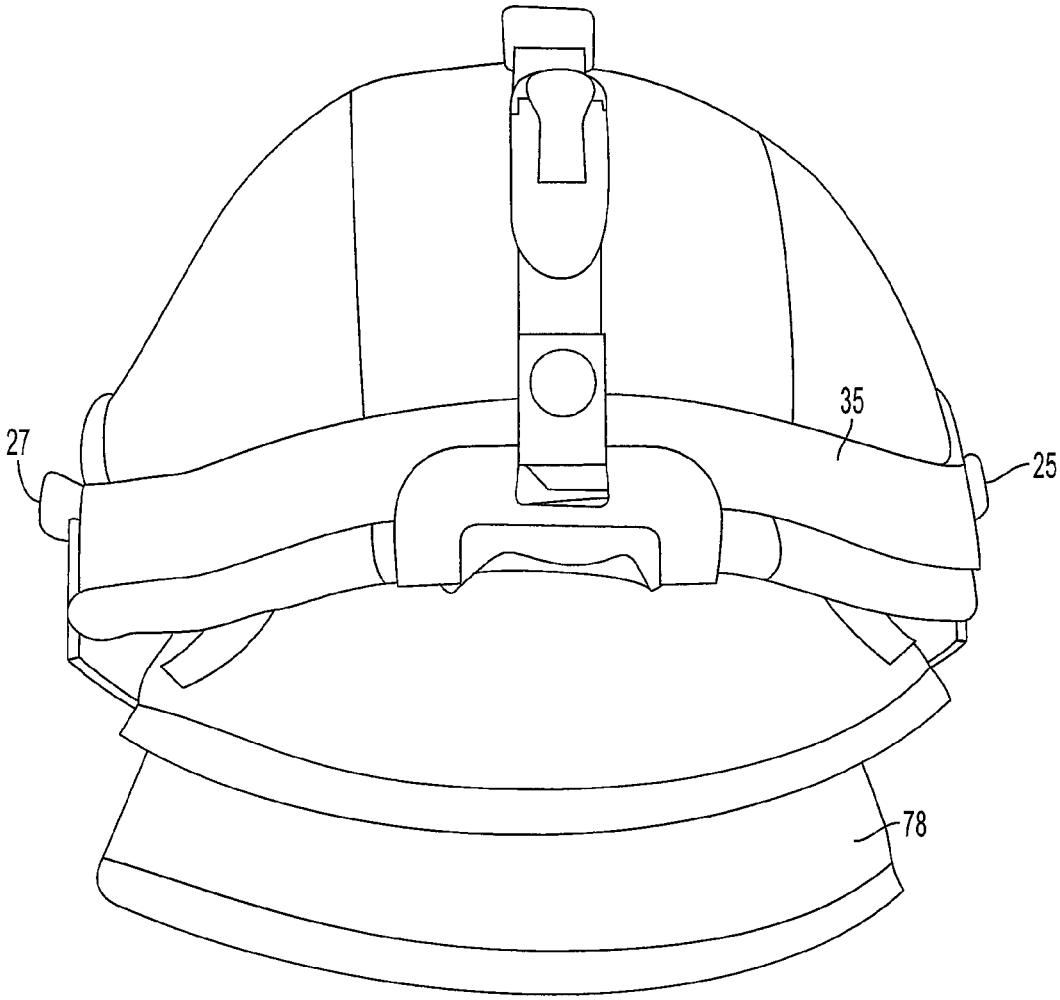
FIG. 12 shows a rear view of the helmet system shown in FIGS. 9, 10 and 11.
Figure 13:
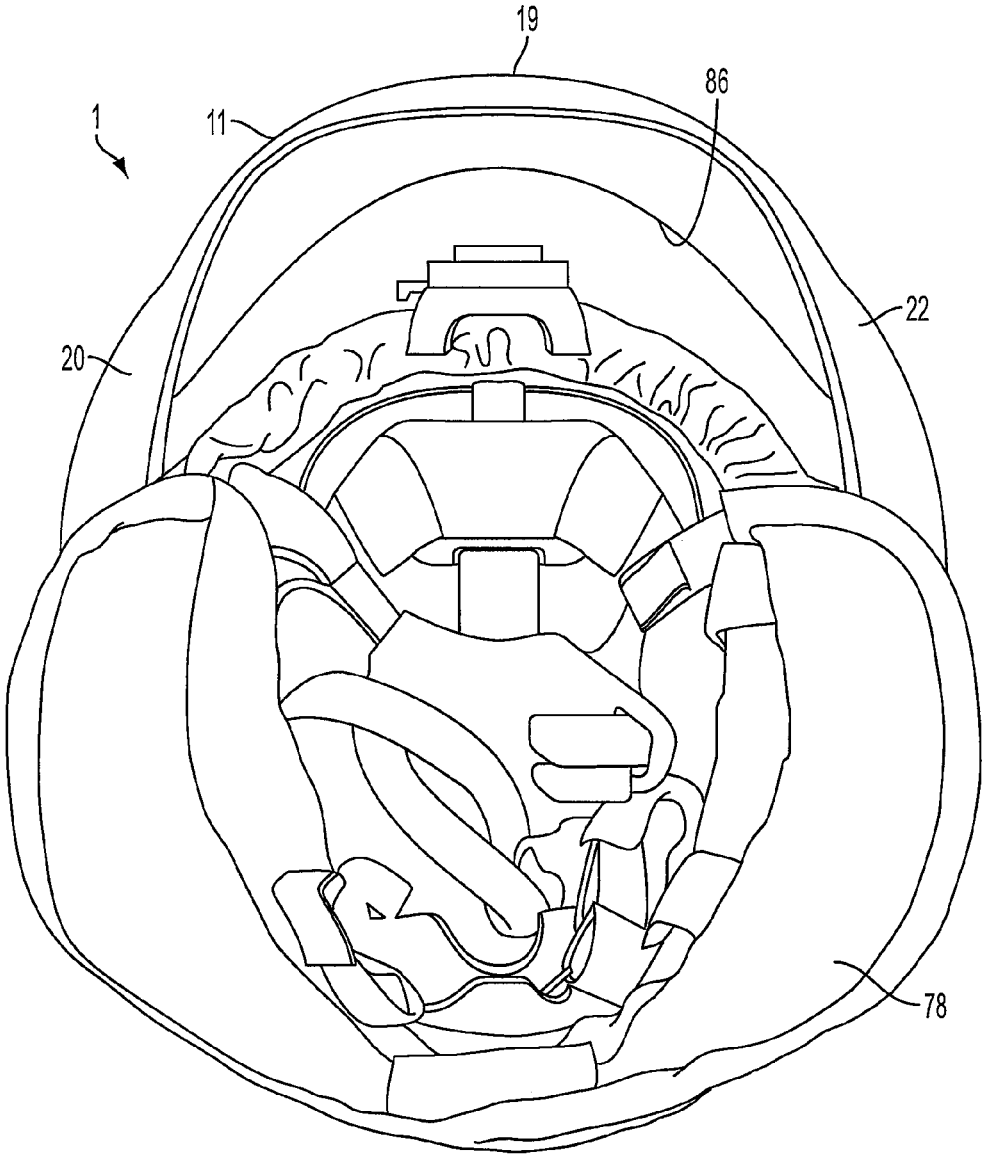
FIG. 13 shows a bottom view of the helmet system shown in FIGS. 9 to 12.
Figure 14:
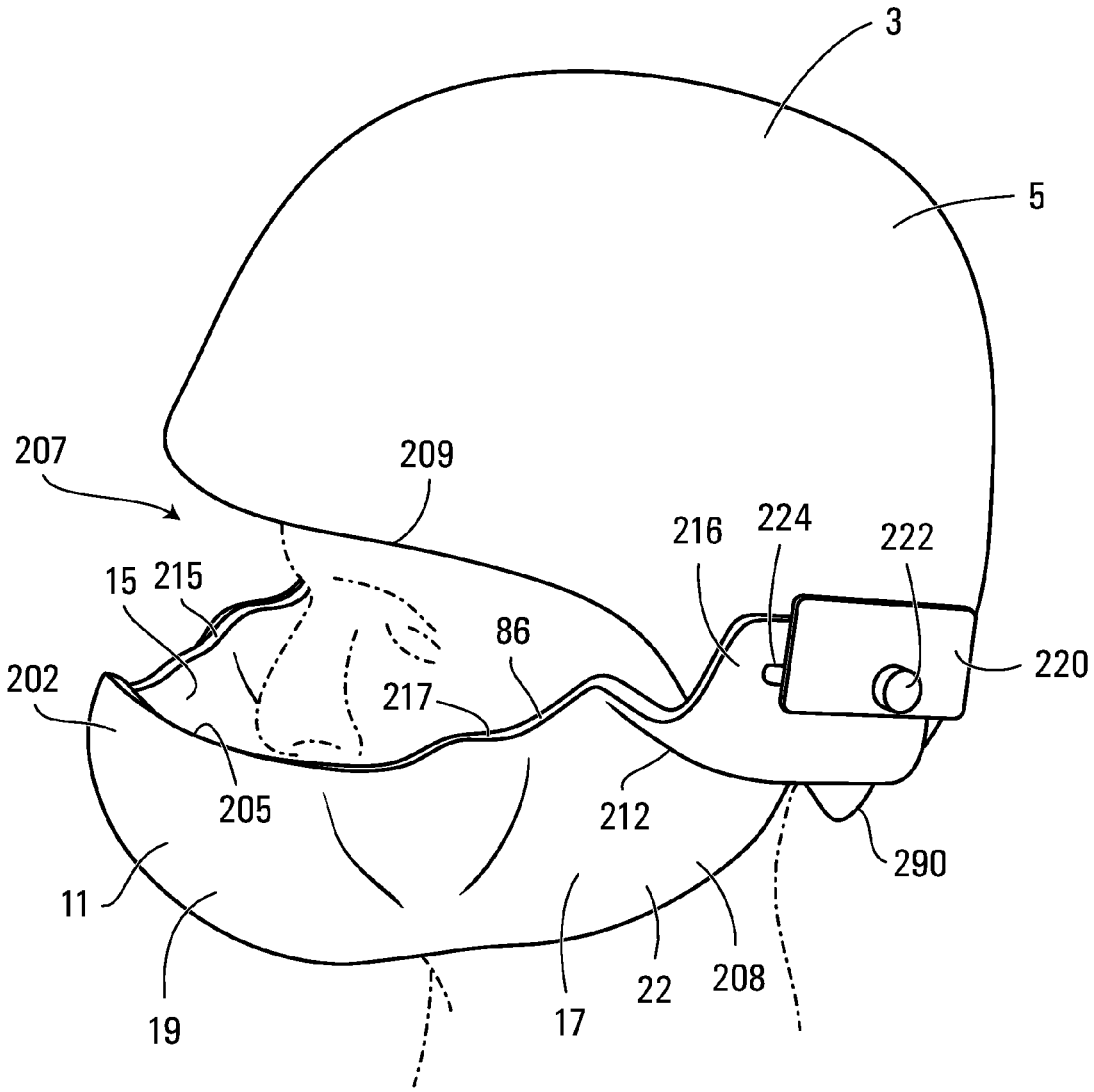
FIG. 14 shows a front and left side perspective view of a face protector according to another embodiment of the present invention.
Figure 15:
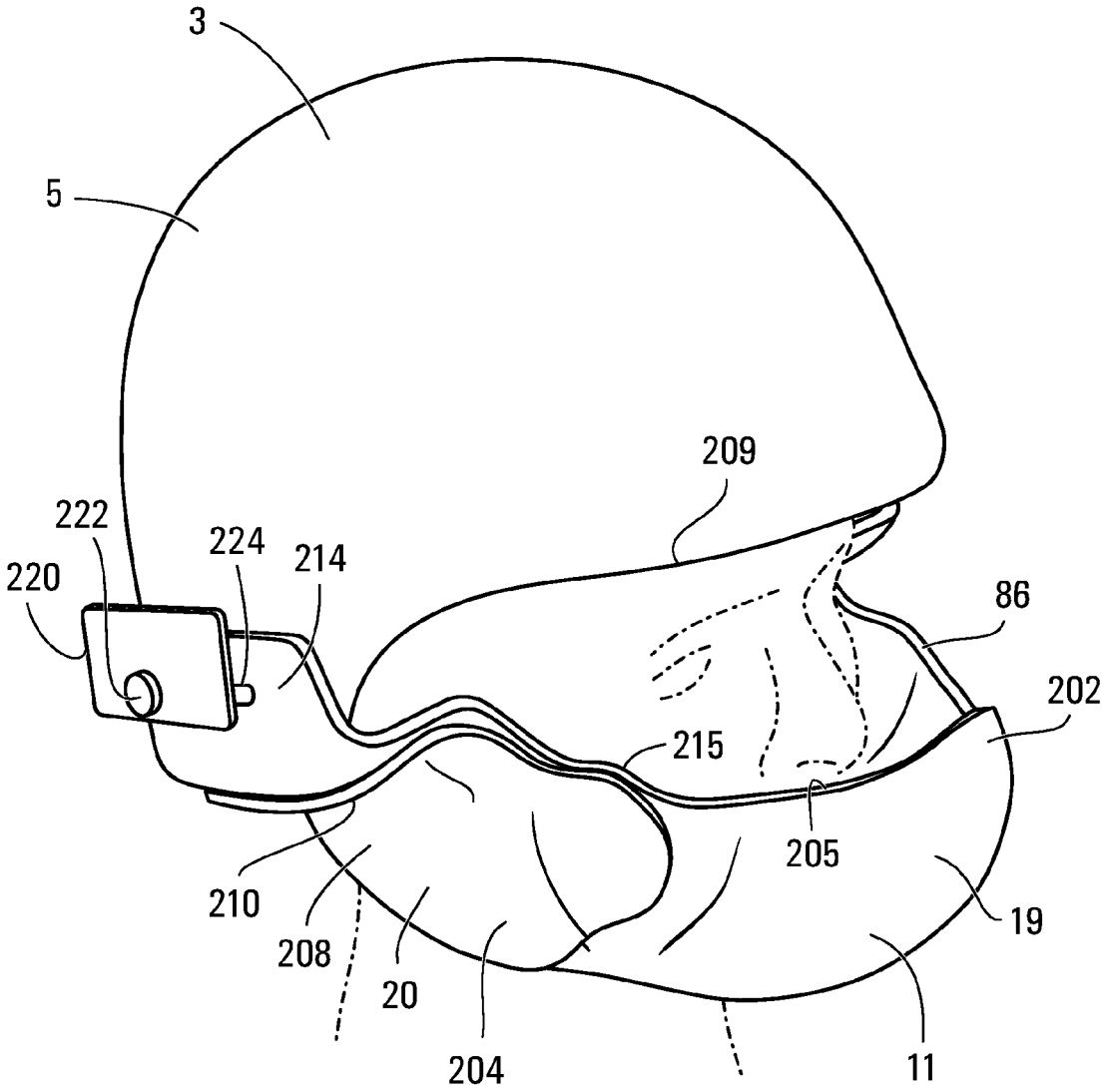
FIG. 15 shows a front and right side perspective view of the face protector of FIG. 14.

Referring to FIG. 8, the face protector may comprise a structure which is effective in protecting a person's face against ballistic objects such as bullets or fragments, and may comprise a ballistic resistant material. In one embodiment, the face protector comprises a plurality of layers of ballistic resistant (high tensile strength) material such as Spectra.TM., Twaron.TM., Dyneema.TM., Kevlar.TM., Nylon.TM. or any other material including any aramid based materials. The face protector may comprise a rigid or semi-rigid structure, and in one embodiment, is formed of one or more layers of resin or other polymer impregnated ballistic resistant fabric 102, 103, 104, which may be molded and formed by applying at least one of pressure and heat.

The resulting structure of the face protector may withstand impacts from ballistic objects having a velocity of more than 200 m/second, for example 400 or 500 m/second or more.

FIGS. 9 to 13 show various views of a face protector mounted to a helmet system. The face protector is similar to that shown in FIGS. 5 to 7 and the helmet system is similar to that shown in FIGS. 1 to 3, and like parts are designated by the same reference numerals. Thus, the description of the various components described above apply equally well to the components of the helmet system shown in FIGS. 9 to 13.

FIGS. 14 to 29 show a lower face protector according to another embodiment of the present invention. The face protector is similar in some respects to that shown in FIGS. 5 to 13, and similar parts are designated by the same reference numerals. Furthermore, the description of the various components of the face protector described above with reference to FIGS. 5 to 13 applies equally to the face protector shown in FIGS. 16 to 29.

Referring to FIGS. 14 to 29, the face protector 11 comprises right and left side portions 15, 17 and a front portion 19. The side portions are generally designed to cover a person's lower jaw region, and the front portion 19 is shaped and sized to cover a person's chin, and in this embodiment also the mouth region, and a lower portion of the nose. Thus, in comparison to the face protector shown in FIG. 5, the front portion 19 includes an upper extension 202 which extends upwardly to cover at least a portion of the lower nose region.

The front portion of the face protector has a free upper edge 205 which is positioned below eye level and above mouth level, and in part defines an opening 207 to the ambient between the face protector and the lower edge 209 of the helmet 3. The upper edge 205 is positioned so as not to obstruct a user's vision or ability to aim a weapon or other device. The inner surface 211 and the free upper edge 205 of the front portion 19 are arranged to provide a gap 213 between the face protector and a person's face for the passage of air therebetween to permit unobstructed breathing and unimpaired oral communication.

In this embodiment, the right and left side portions of the face protector each have an upper free edge 215, 217, which are also positioned at or below eye level and generally above mouth level. The upper edges also define an opening 207 with the lower edge 209 of the helmet 3.

Figure 16:
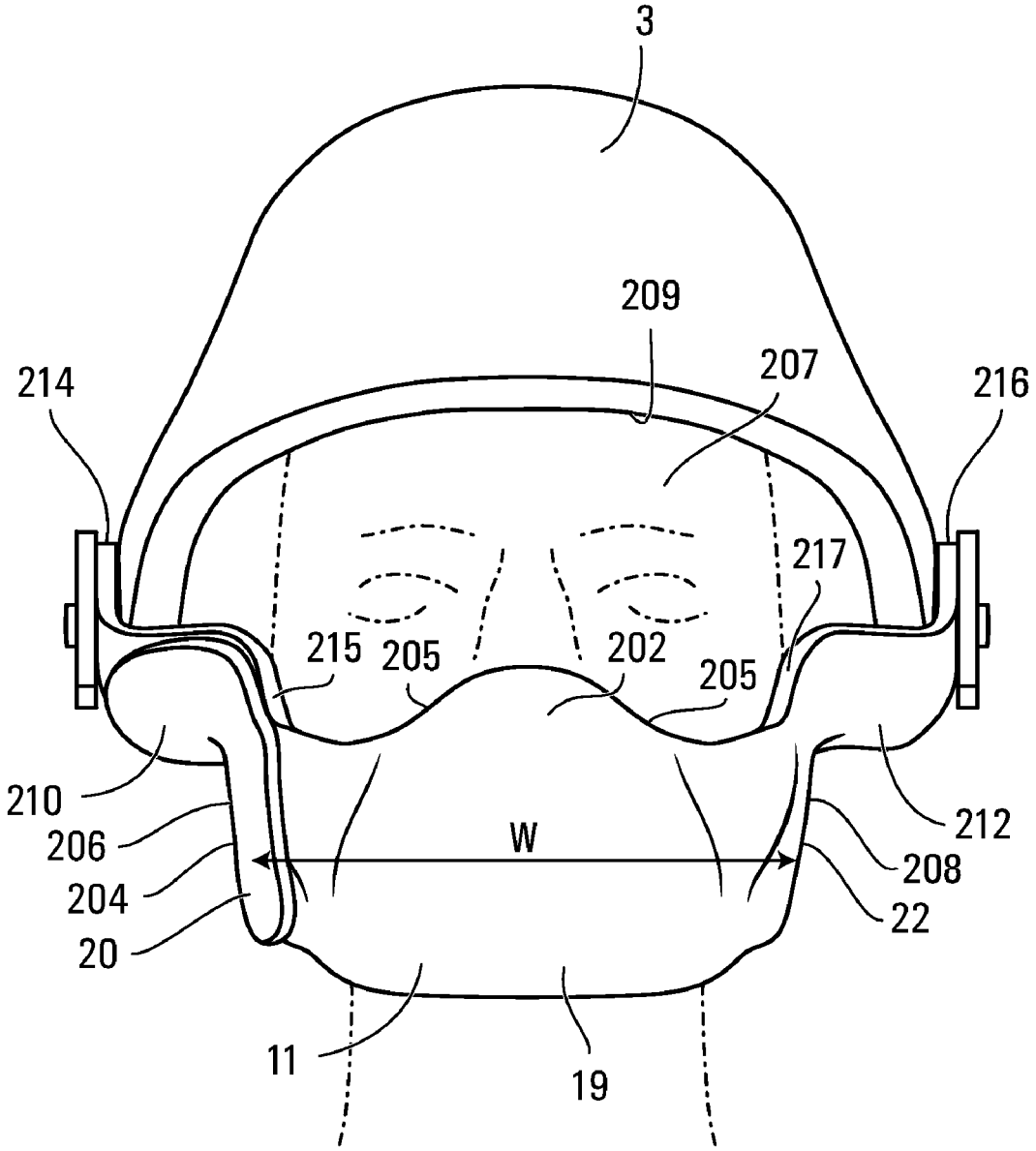
FIG. 16 shows a front view of the face protector shown in FIG. 14.
Figure 24:
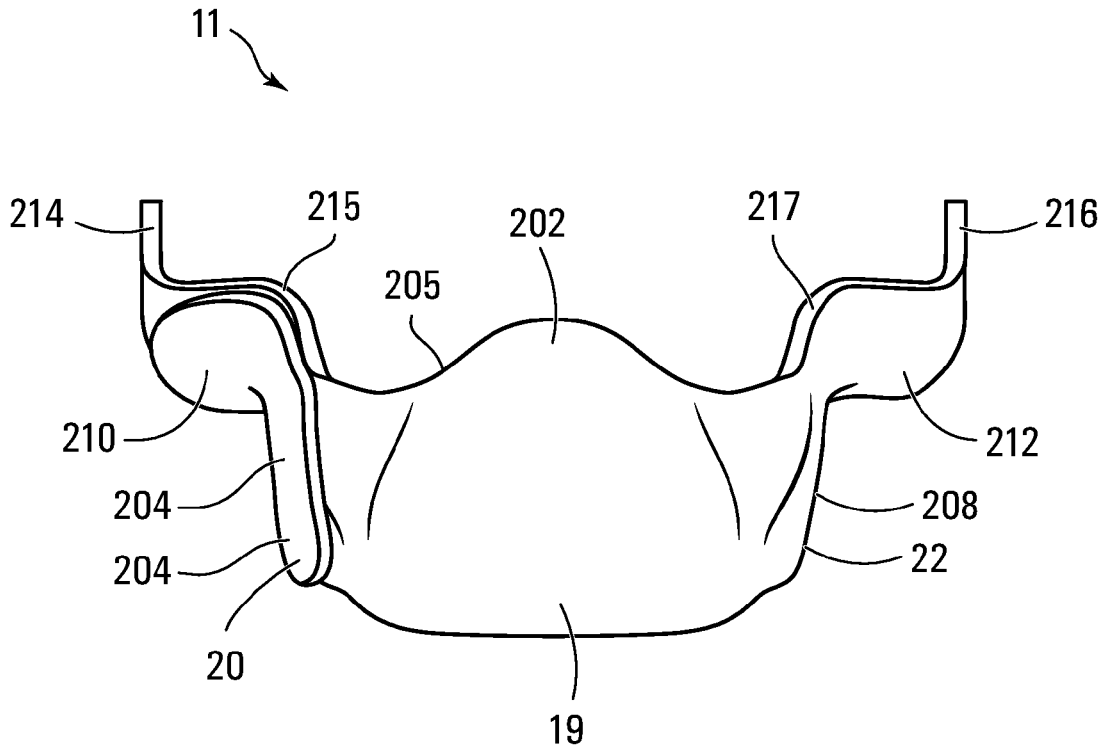
FIG. 24 shows a front view of the face protector shown in FIG. 14.
Figure 25:
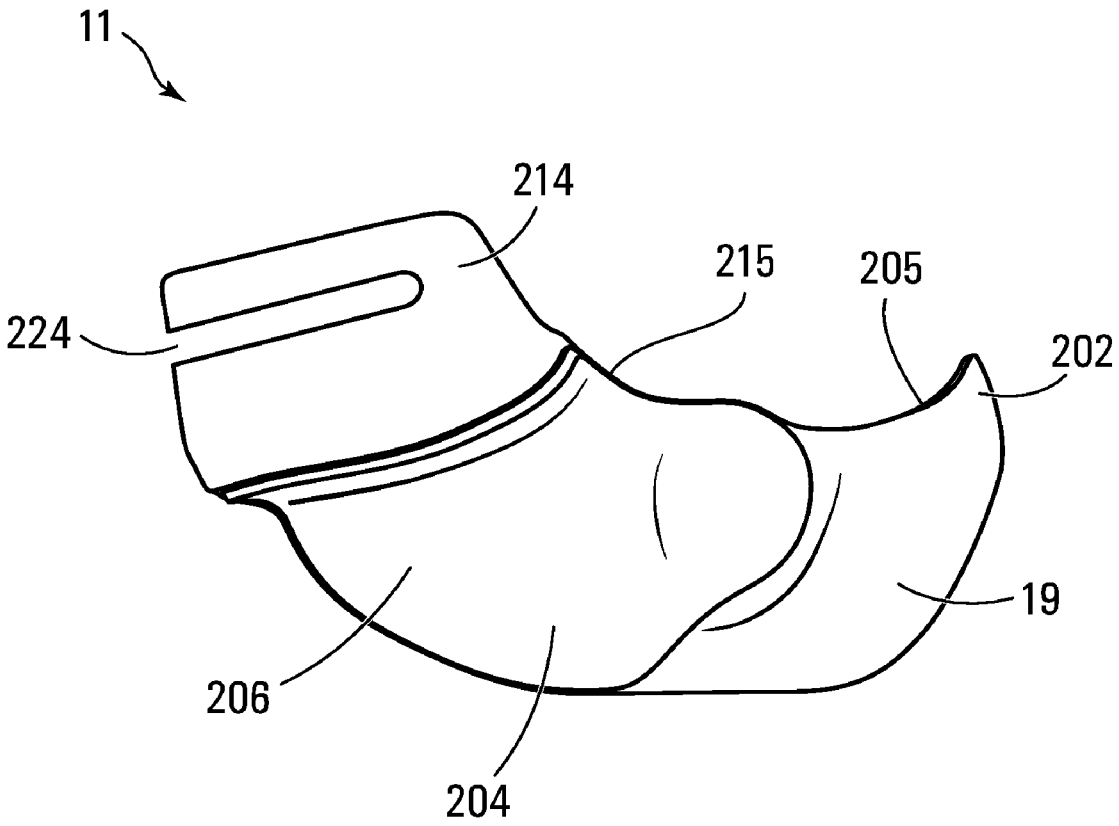
FIG. 25 shows a right side view of the face protector shown in FIG. 14.
Figure 26:
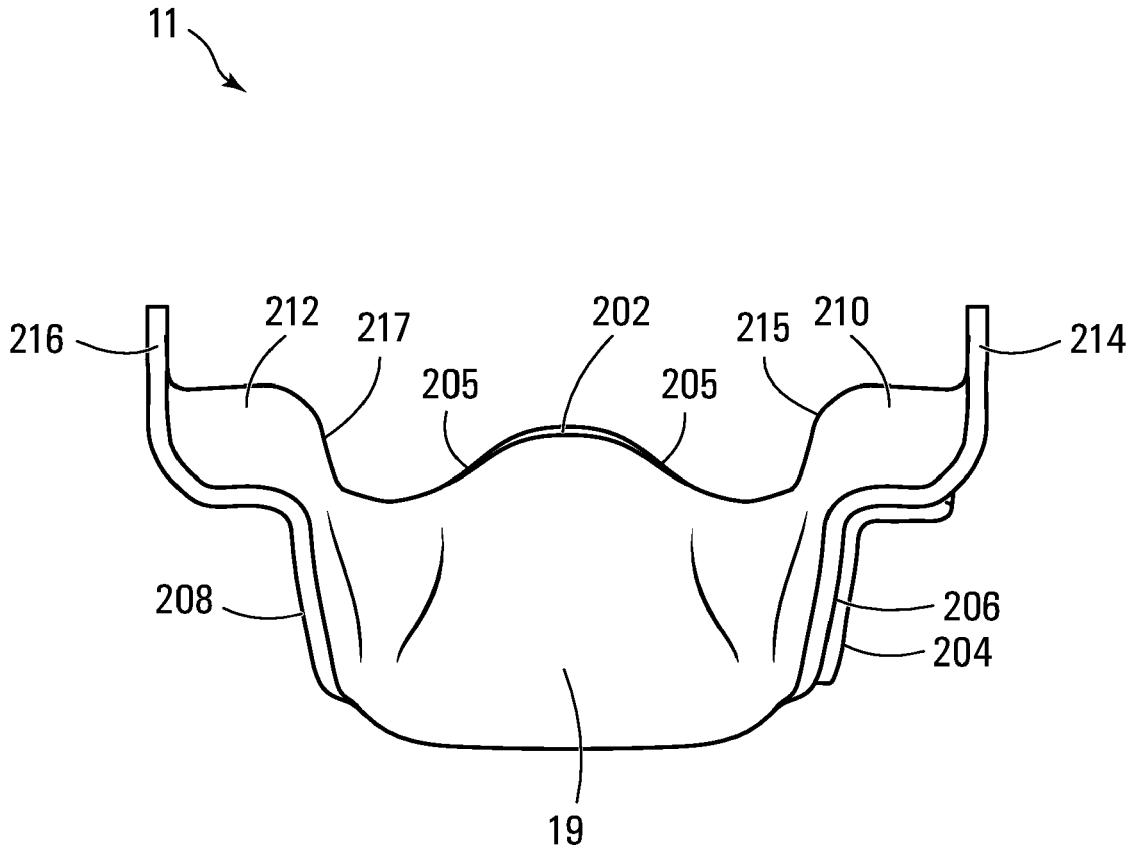
FIG. 26 shows a rear view of the face protector shown in FIG. 14.
Figure 27:
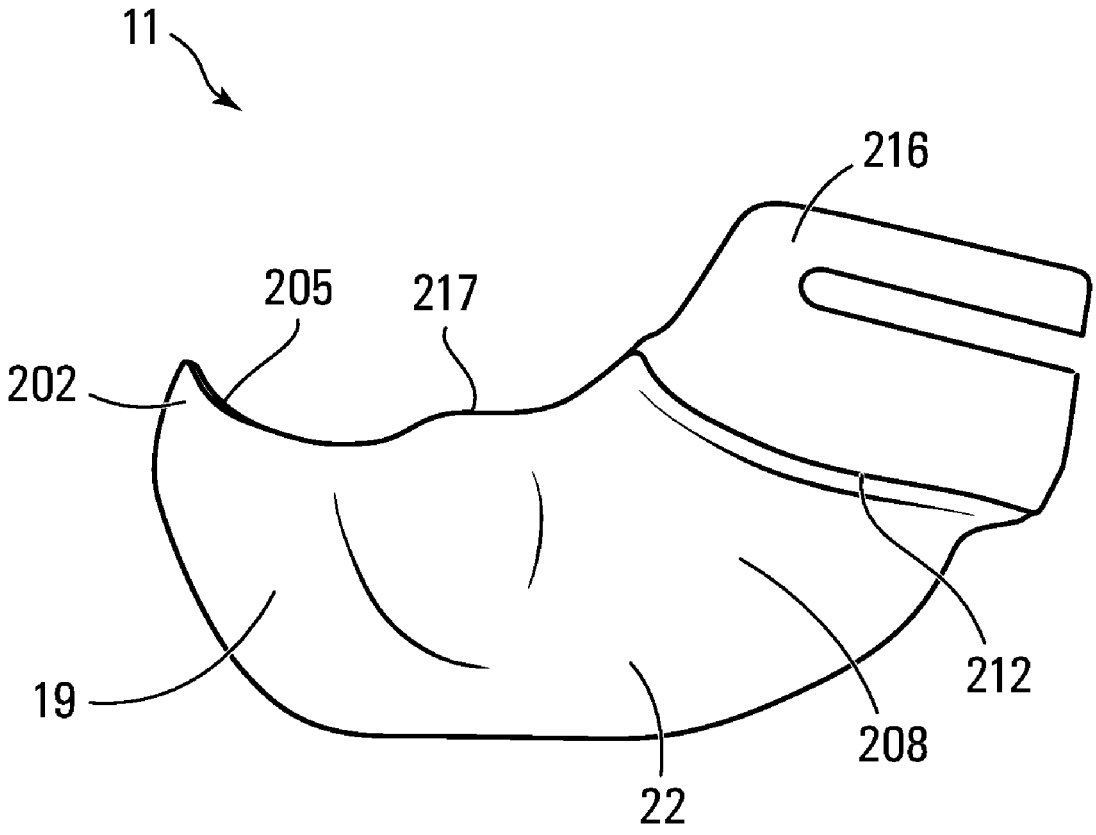
FIG. 27 shows a left side view of the face protector shown in FIG. 14.
Figure 28:
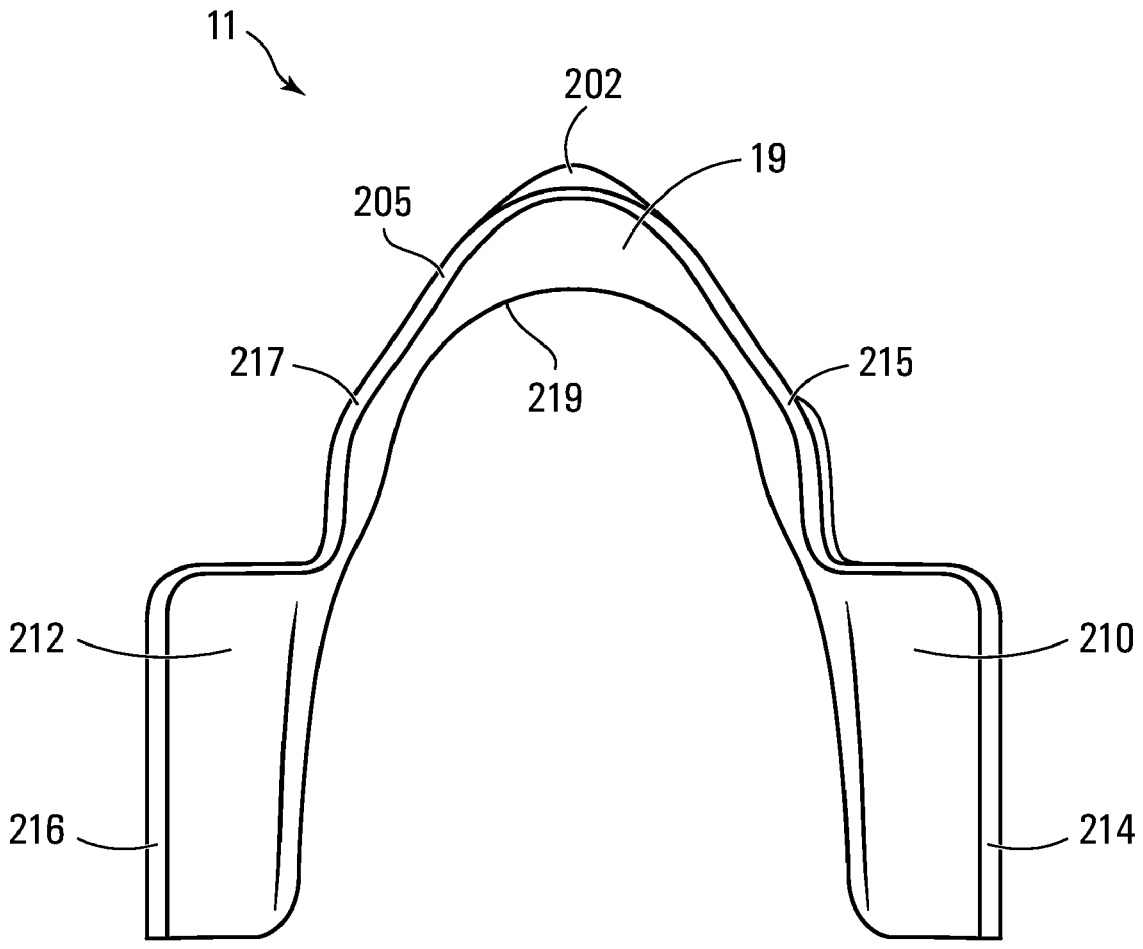
FIG. 28 shows a top view of the face protector shown in FIG. 14.
Figure 29:
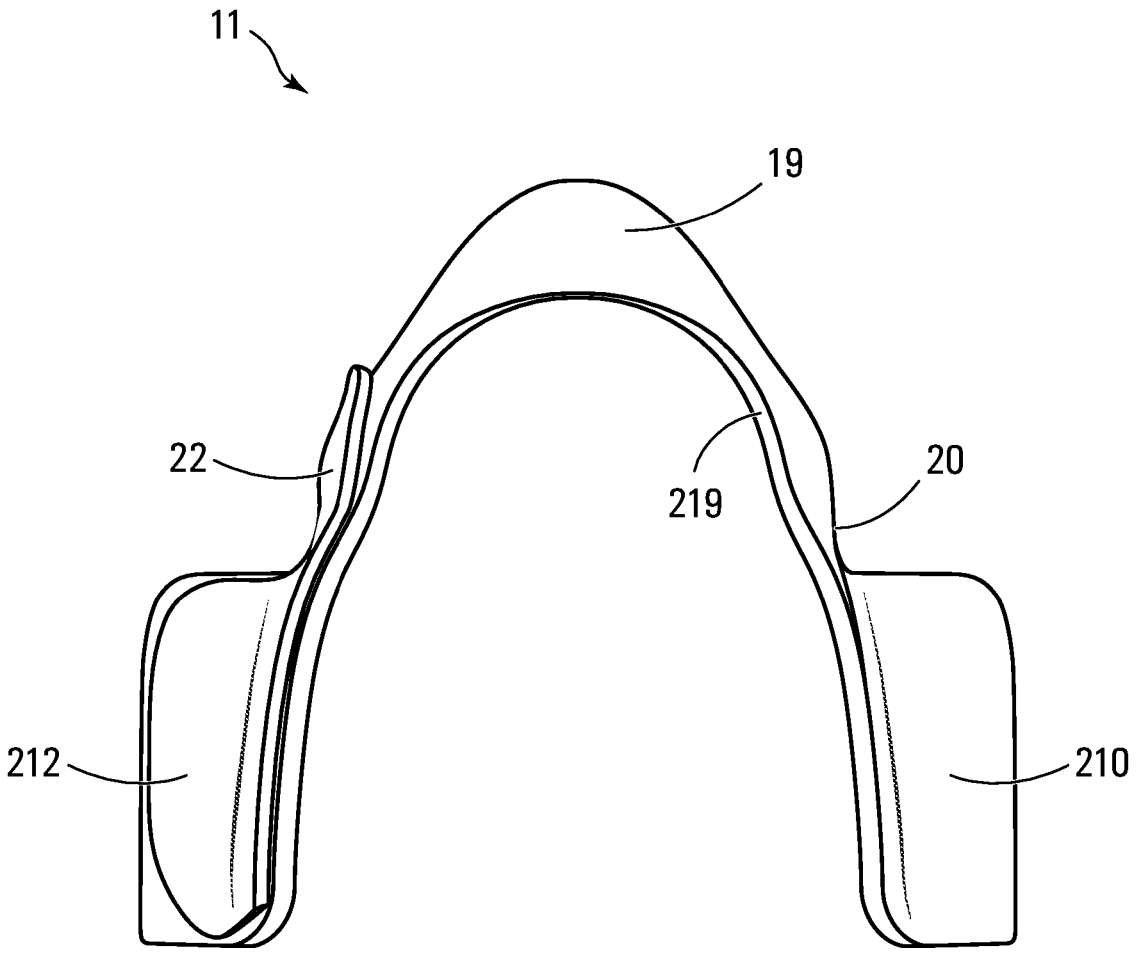
FIG. 29 shows a bottom view of the face protector shown in FIG. 14.

The lower part 20, 22 of the right and left side portions are scalloped, as for example shown in the front views of FIGS. 16 and 24, to reduce interference between the face protector and a shoulder mounted device, such as a rifle or other weapon. In comparison to the face protector shown in FIGS. 5 to 13, the scalloped region is more accentuated in the embodiment of FIGS. 16 to 29. Advantageously, the scalloped regions allow a person to tilt his/her head towards a rifle or other shoulder mounted device so that the user can look along the rifle sights. In this embodiment, the scalloped region on the right hand side includes a region or area 204 of resilient or relatively soft material positioned on the outer surface thereof to provide cushioning between the face protector and the rifle or other shoulder mounted device. The soft material may comprise a rubber based compound such as butyl rubber, possibly impregnated with a ballistic resistant material. In other embodiments, the soft region may be provided by a gel-type material or other soft material such as foam. A soft region may in addition or alternatively be placed on the left hand side of the scalloped region, for left handed users, for example.

Figure 17:
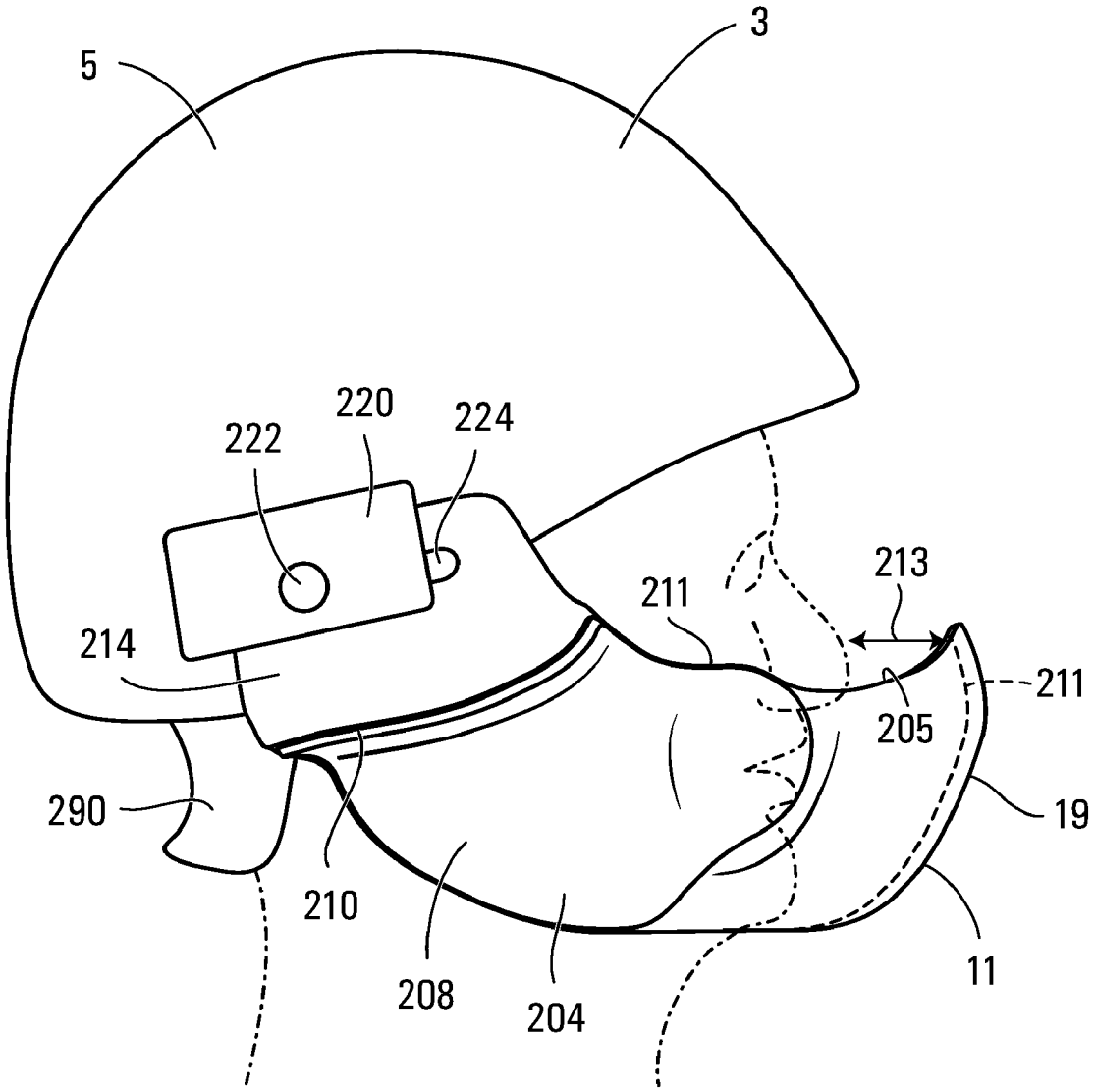
FIG. 17 shows a right side view of the face protector shown in FIG. 14.
Figure 18:
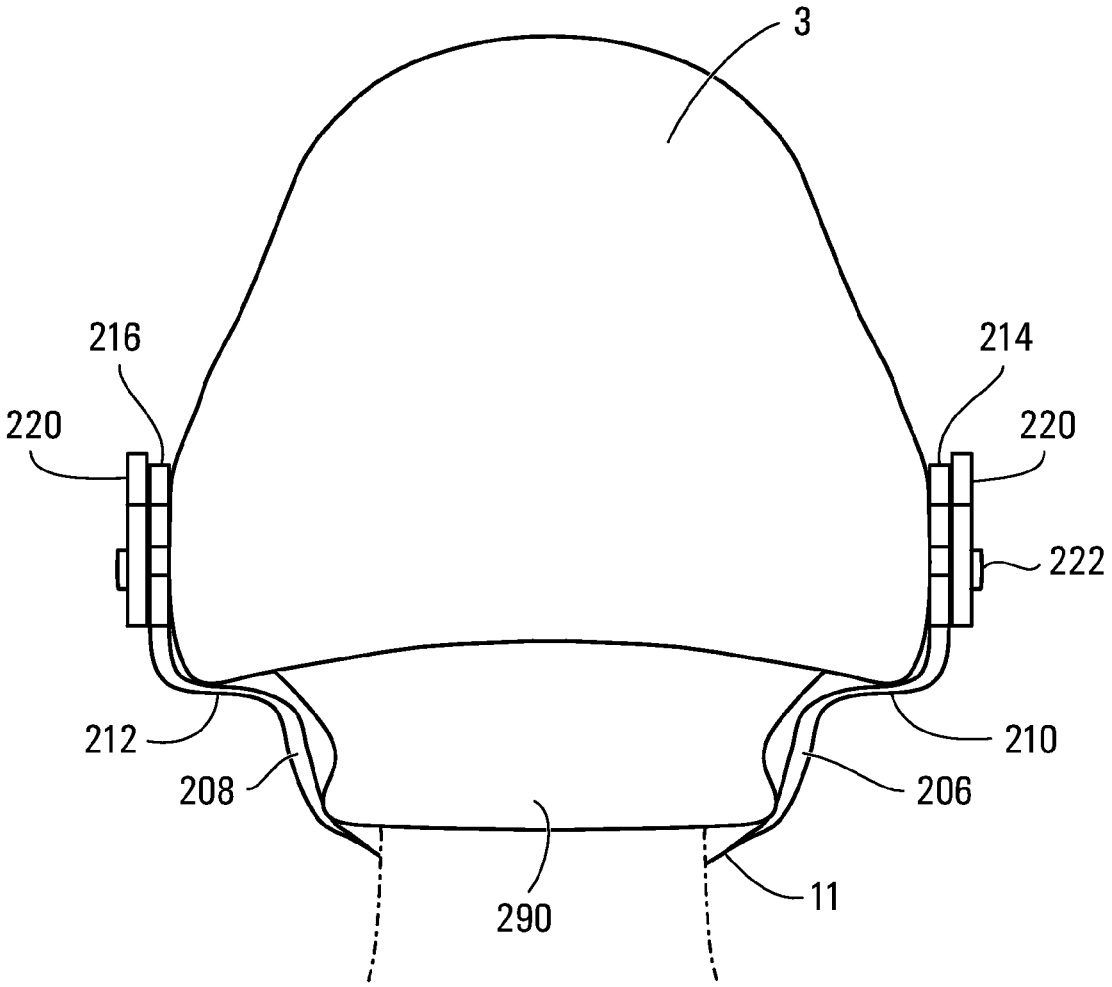
FIG. 18 shows a rear view of the face protector shown in FIG. 14.
Figure 19:
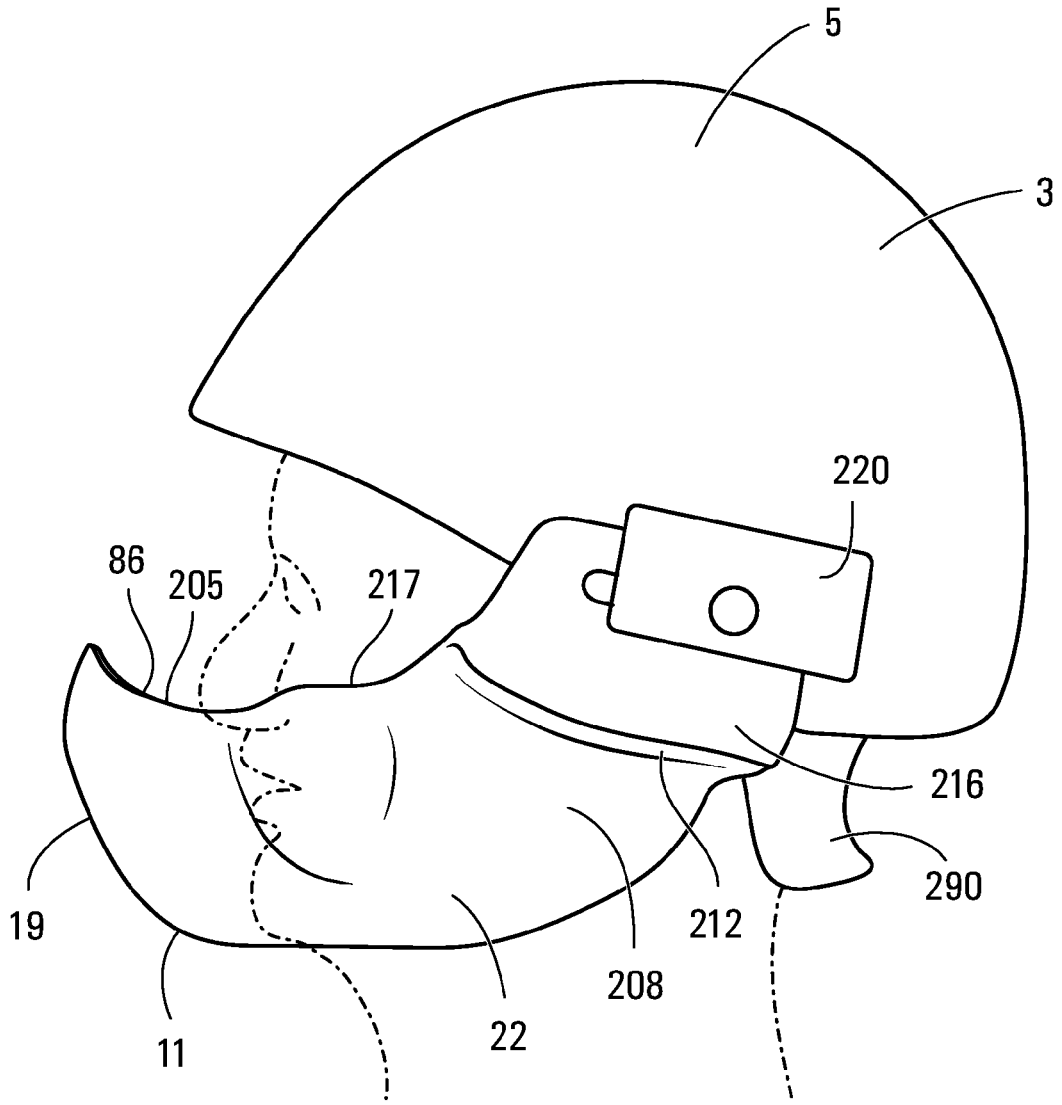
FIG. 19 shows a left side view of the face protector shown in FIG. 14.
Figure 20:
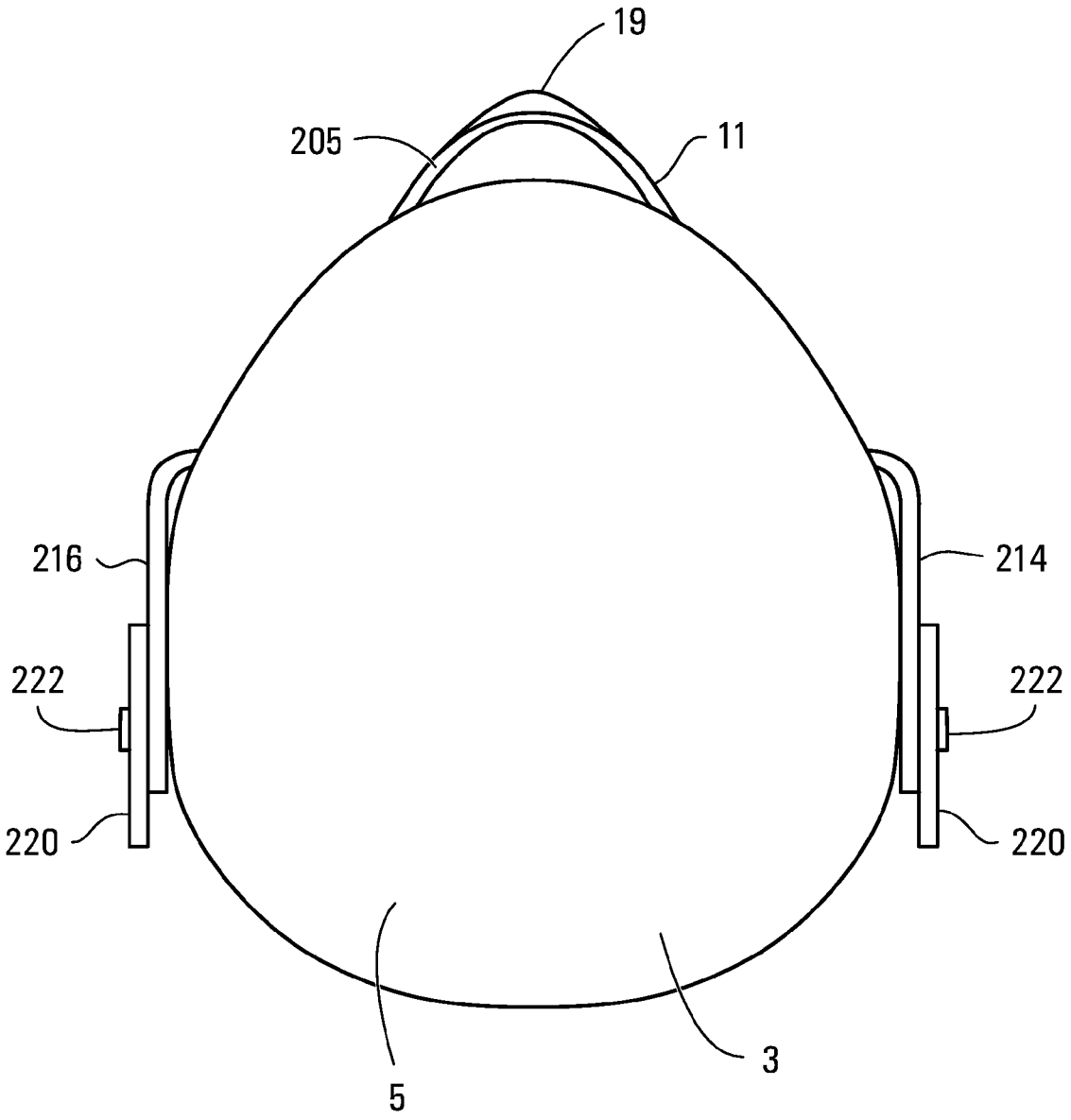
FIG. 20 shows a top view of the face protector shown in FIG. 14.

Referring to FIGS. 16 and 24, the face protector generally fits closer to a wearer than the embodiment of FIGS. 5 to 13. The distance or spacing W between the opposed lower side portions 20, 22 is similar to the width of a wearer's jaw, and reduces interference between the face protector and a shoulder mounted device. The lower scalloped side portions 206, 208 are inclined steeply and generally conform to the profile of the sides of a wearer's face. The side portions of the face protector include left and right outwardly extending portions 210, 212 and the lower surface of these portions extend outwardly substantially horizontally as shown in FIGS. 16 and 24 so that the recessed portions 206, 208 are relatively angular. The outwardly extending portions extend from a position of the face protector which is at about the same level as the lower edge of the front side portions of a helmet, and include an upwardly extending side flange 214, 216 to facilitate mounting the face protector to a helmet, for example a military helmet such as a standard combat helmet. In this embodiment, the outwardly extending portions extend sufficiently to enable the flanges 214, 216 to be fastened to the outside of the helmet, but in other embodiments, the flanges may be positioned for insertion into and mounting on the inside of the helmet, or otherwise the face protector may be mounted on the inside of the helmet. As shown in FIG. 17 for example, in this embodiment, the mounting system includes a clamping plate 220 and a screw 222 which passes through an aperture such as a slot 224 formed in the flange portion 214, 216 of the face protector to clamp the face protector to the outside of the helmet. However, in other embodiments, any other suitable mounting mechanism may be used, for example the 'picatinny' type mounting system described above, or any other suitable mounting system. The mounting system may be adapted to allow the face protector to be moved towards and away from a wearer's face, i.e. towards and away from the front of the helmet, and a slot 224 formed in the mounting flange 214, 216 may be provided for this purpose.

Figure 21:
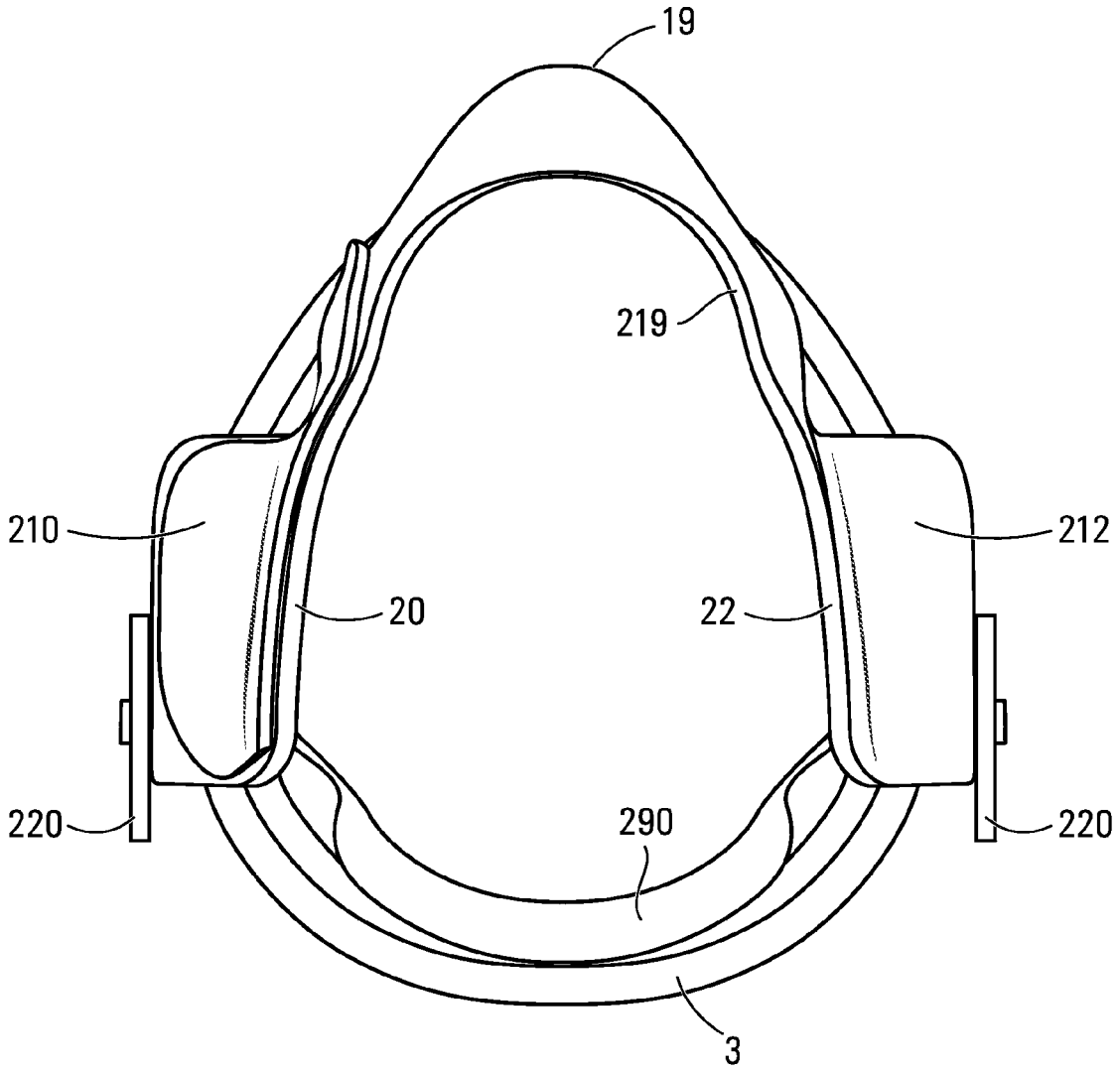
FIG. 21 shows a bottom view of the face protector shown in FIG. 14.
Figure 22:
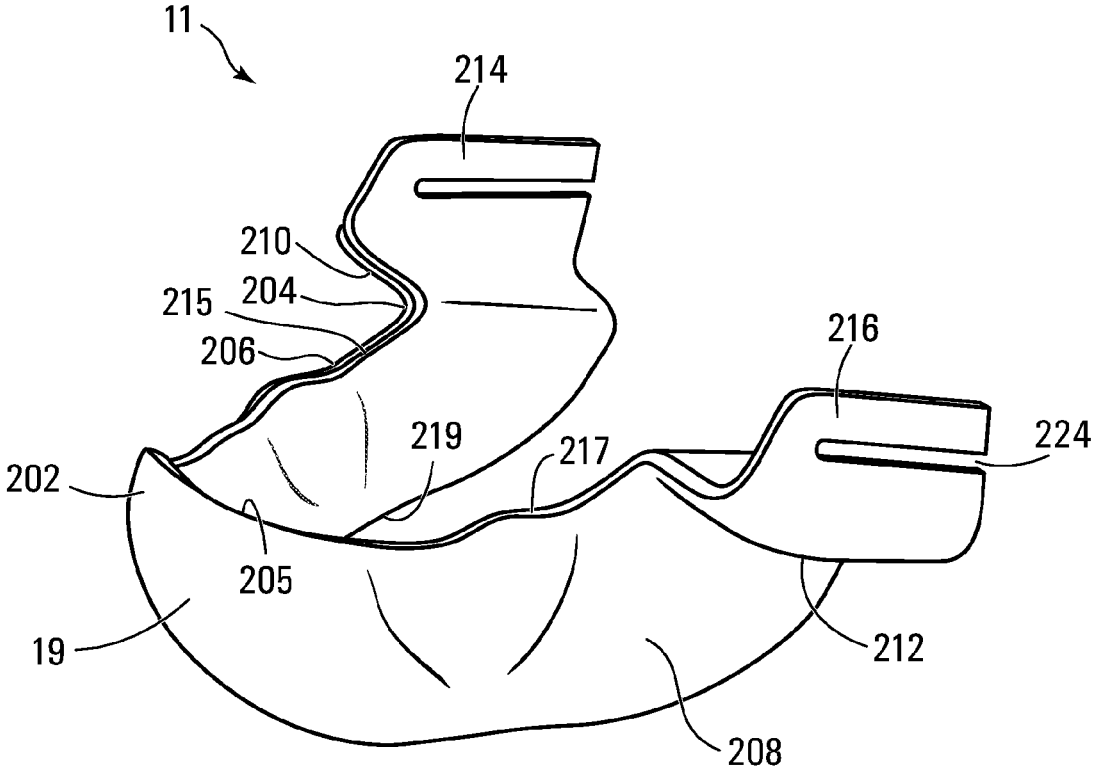
FIG. 22 shows a front and left side perspective view of the face protector shown in FIG. 14.
Figure 23:
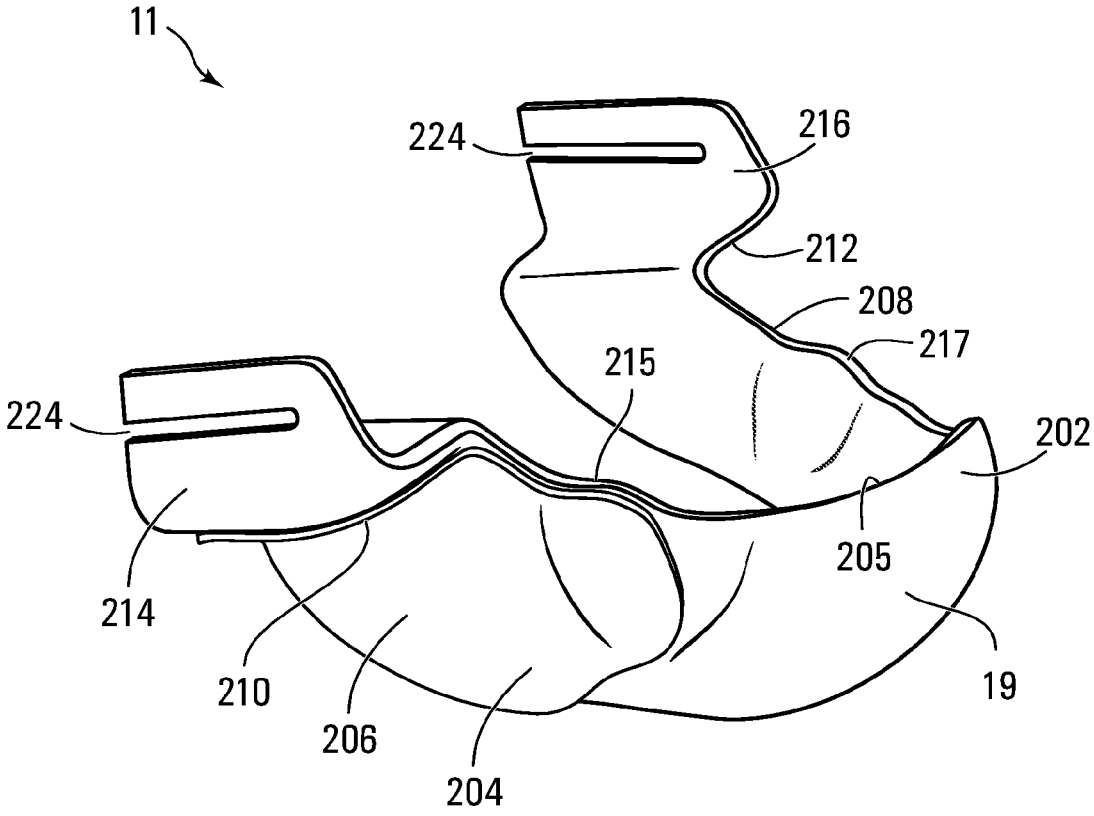
FIG. 23 shows a front and right side perspective view of the face protector shown in FIG. 14.

As shown in FIG. 21, the face protector has a lower peripheral edge 219, which extends about the lower jaw region, and is generally "U" or horseshoe shaped. The lower peripheral edge may also be sized, shaped and/or positioned so as to be spaced apart from a person's lower jaw to provide a gap therebetween, for example, so as not to interfere with movement thereof, and allow ambient air to pass therethrough for breathing.

The face protector may comprise any suitable material such as polycarbonate, acrylic, one or more layers of ballistic resistant fabric such as a high tensile strength fabric, e.g. an aramid based or polymeric based material, examples of which include Kevlar™, Nylon™ Twaron™, Dyneema™, as well as others. As shown in FIG. 17, the face protector generally covers the mandibular region including the front and rear lower jawbone, and also extends to at least partially cover the cheek area of a wearer.

In this embodiment, the helmet system includes a nape protector 290 mounted to extend downwardly from the rear of the helmet 3 to provide additional protection to the occipital and neck regions. The nape protector may comprise a ballistic resistant material and may be rigid or semi-rigid. In one embodiment, the nape protector has a similar construction to the face protector. The nape protector is described in more detail in the applicant's co-pending U.S. patent application Ser. No. 11/277,106 filed on 21 Mar. 2006, the entire content of which is incorporated herein by reference.

Figure 30:
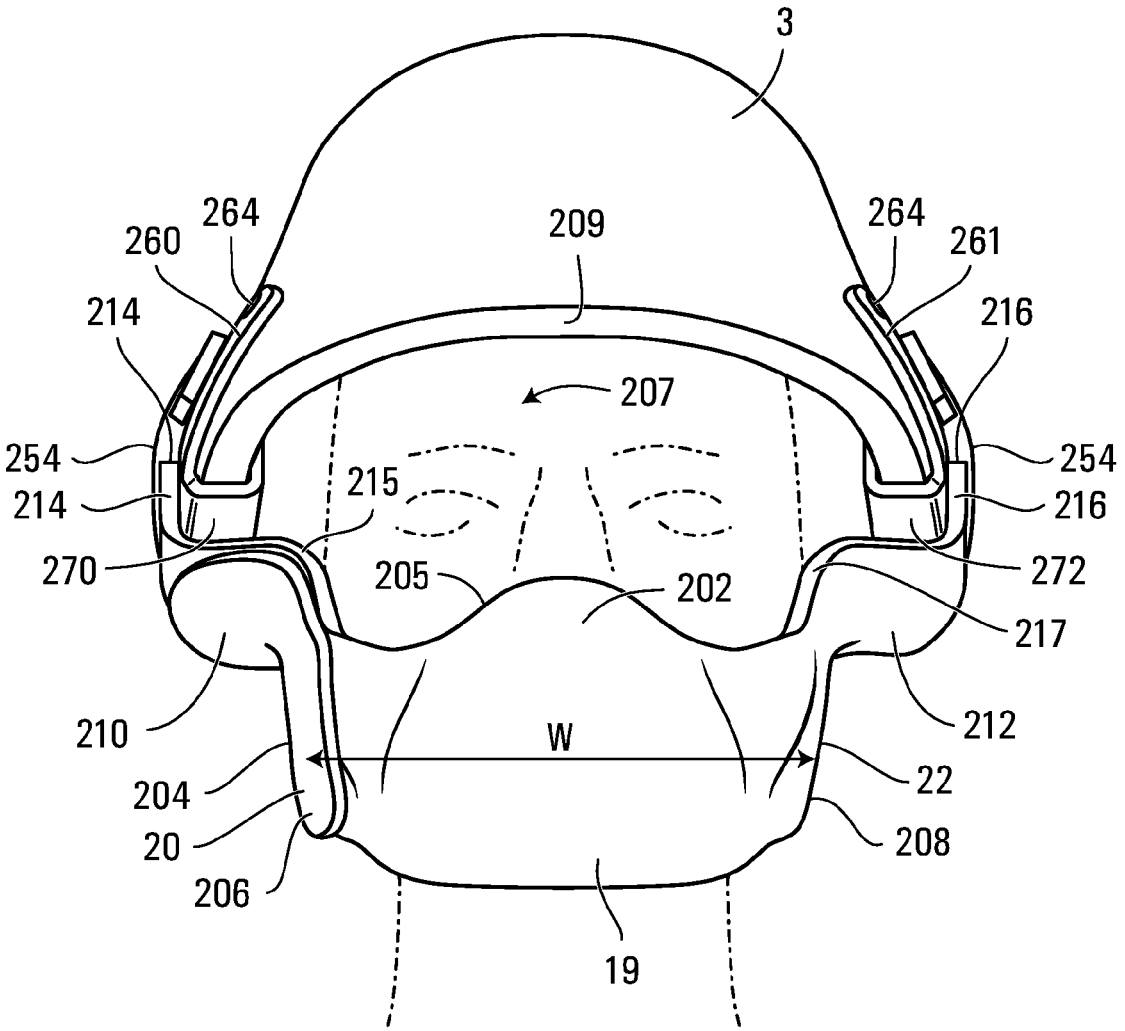
FIG. 30 shows a front view of a lower face protector according to another embodiment of the present invention.
Figure 31:
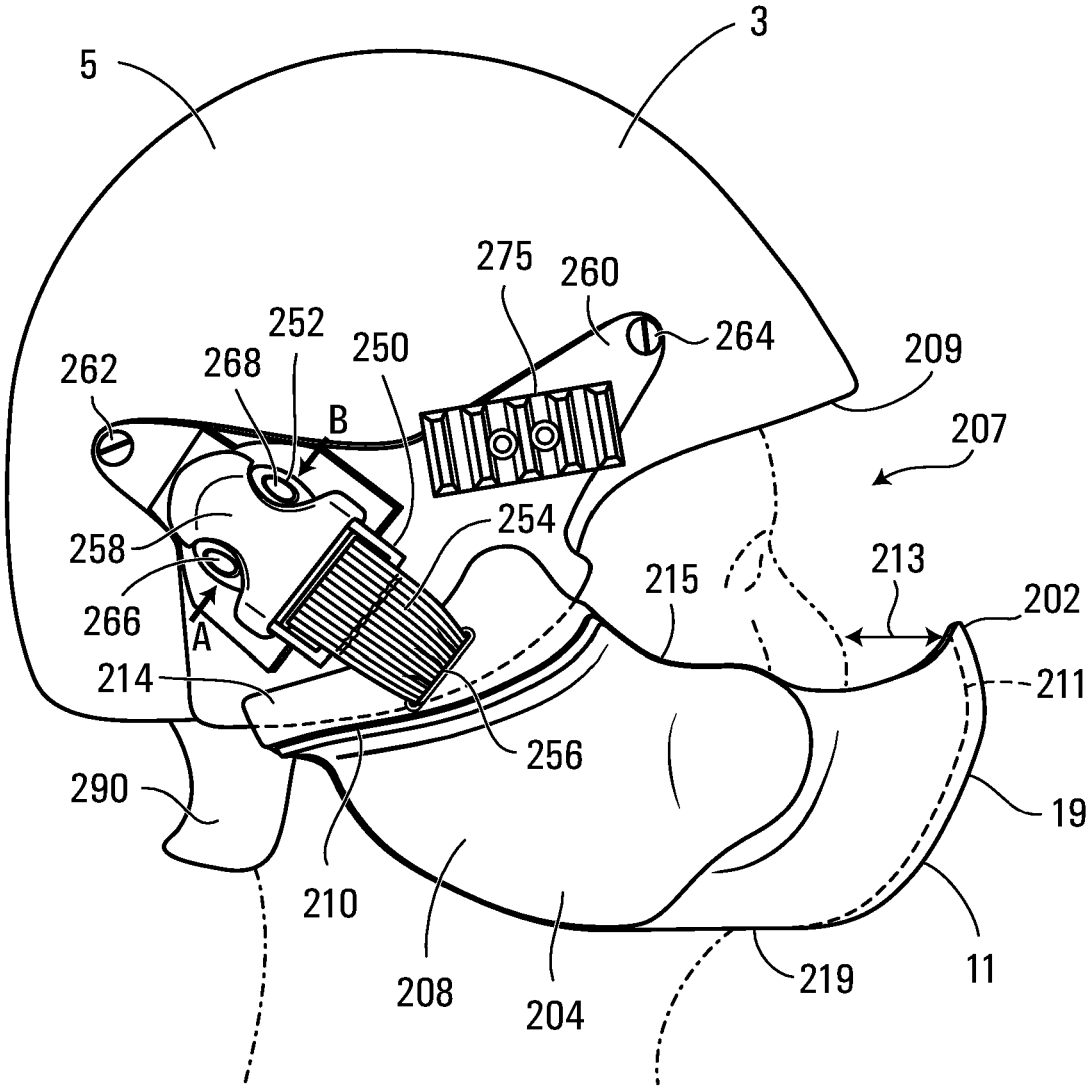
FIG. 31 shows a side view of the face protector shown in FIG. 30.
Figure 32:
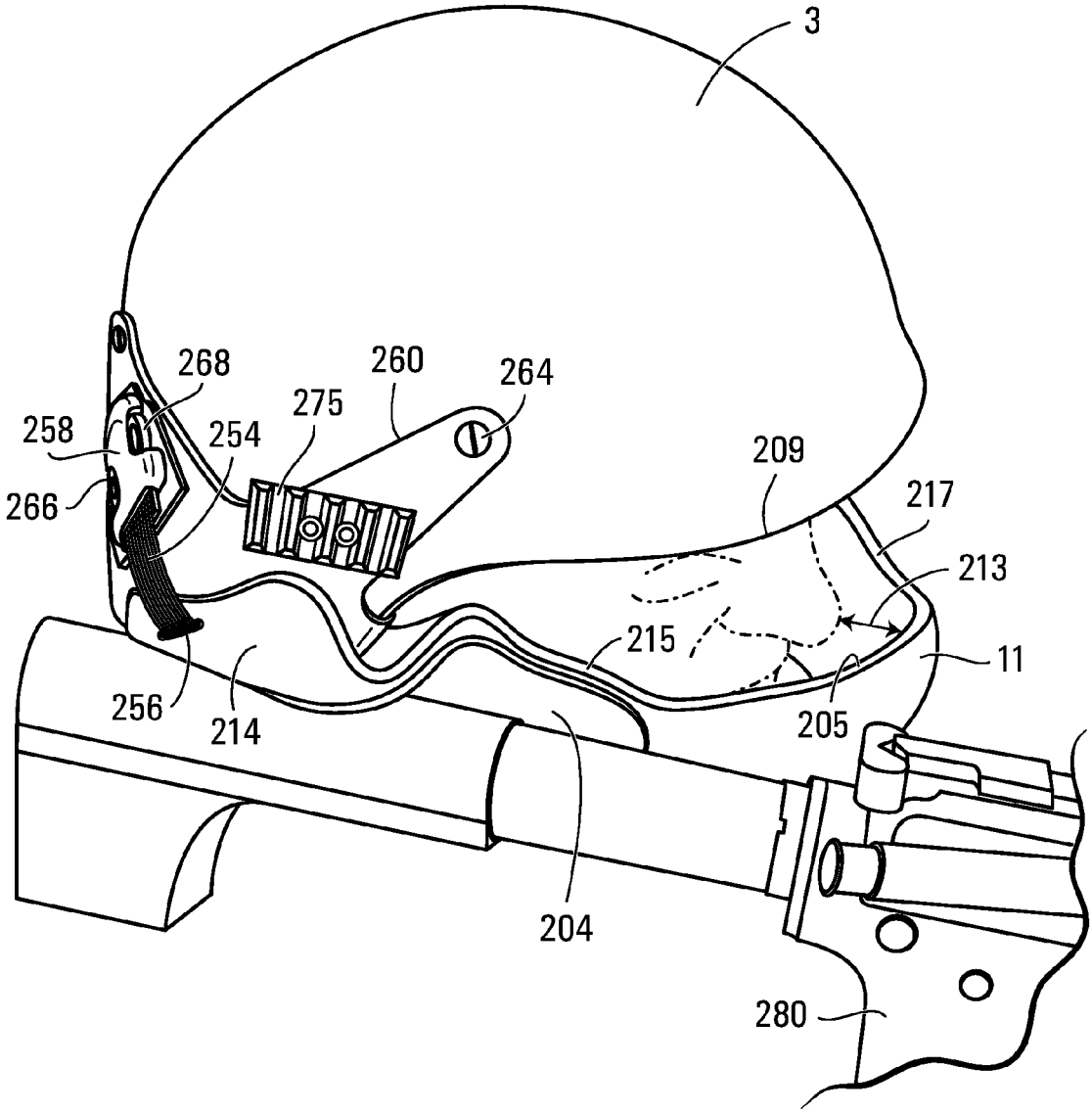
FIG. 32 shows a side and front perspective view of the face protector shown in FIGS. 30 and 31.

FIGS. 30 to 32 shown an example of a lower face protector and protective system according to another embodiment of the present invention. The lower face protector is similar to that shown in FIGS. 16 to 29, and like parts are designated by the same reference numerals. Specifically, the shape of the protective region of the lower face protector is similar to that shown in FIGS. 16 to 29 and the description thereof applies equally to FIGS. 30 to 32.

One of the main differences between the embodiment of FIGS. 16 to 29 and that shown in FIGS. 30 to 32 is the fastening system for fastening the face protector to a helmet. Referring to FIGS. 30 to 32, the fastening system generally shown at 250 comprises a clip type fastening mechanism for releasably fastening the face protector to a helmet 3. The fastening system comprises a male clip 252 which is connected to the face protector 11 by means of a web 254 which passes through a slot 256 formed in the upwardly extending side flanges 214, 216. The fastening mechanism further comprises a female socket or receptacle 258 for receiving the clip 252, and which is fixed to a bracket 260 mounted on the outside of the helmet shell. (In other embodiments, the female socket may be mounted on the face protector and the male clip mounted on the helmet.) In this embodiment, the bracket is mounted to the helmet shell by means of bolts or screws 262, 264 which are positioned to pass through existing through holes for securing a helmet retention system to the inside of the helmet. In this way, the bracket can be securely mounted to the helmet without requiring additional holes to be made, which might otherwise weaken the shell structure. In this embodiment, the clip mechanism comprises a pair of opposed, manually accessible spring clips 266, 268, which, when depressed inwardly, i.e. in the direction of arrows A and B release the clip from the receptacle allowing the face protector to be removed.

In this embodiment, the bracket 260 comprises a sheet-like material and extends to and over a portion of the lower edge 209 of the helmet 3. The outwardly extending portions 210, 212 form a seat which abuts and is held against the lower portions 270, 272 of the bracket 260, 261 by the fastening mechanism. It is to be noted that in other embodiments, the bracket 260, 261 need not extend below the lower rim of the helmet, and in this case, the outwardly extending portions may directly abut the lower helmet rim 209.

Advantageously, the fastening mechanism shown in FIGS. 30 to 32 allows the face protector to be quickly and easily attached to and removed from the helmet.

In this embodiment, the protective system further includes a mounting rail 275 for enabling an auxiliary device to be attached to the helmet. As shown in FIG. 31, the mounting rail 275 is attached to the bracket 260, although in other embodiments, the rail could be mounted elsewhere, for example directly to the helmet shell. In this embodiment, the support rail 275 comprises a plurality of upwardly extending and spaced apart protrusions which enables a device to be mounted and locked at different positions on the rail in a similar manner to the picatinny rail described above. (In any embodiments disclosed herein, the slidable mounting, e.g. rail, may be rotatable to allow the mounting to be moved to different angular positions.)

As shown in FIG. 32, the scalloped or recessed region 204 at the side of the face protector enables a shoulder mounted weapon such as a machine gun or rifle 280 to be accommodated therein, enabling a user to look along the gun sights. The recess extends to the rear edge of the face protector so that a device can extend beyond the rear edge without obstruction.

Embodiments of the lower face protector generally provide protection to the nose, lower mandible and throat regions. The face protector may be adapted to fit standard USMC (US Marine Corp) lightweight and advanced combat helmets using existing bolt holes and can be field mounted and replaced, as necessary. Embodiments of the face protector can be released using one hand and are fully compatible with M16 series weapons using ion sights or optics and/or other vision systems. Embodiments of face protector are adapted to provide facial coverage without obstructing vision, aiming or breathing.

In some embodiments, the protective structure may be adapted to withstand ballistic impacts of velocities of 200 meters/second (656 feet/second) and 17 gram FSP fragments.

In some embodiments, the face protector may include a ceramic front piece to increase the level of protection. In other embodiments, the face protector may include a ceramic material, which may be disposed in one or more selected region(s) thereof or may extend fully over the area of the face protector.

Other aspects and embodiments of the present invention comprise any one or more feature(s) disclosed herein in combination with any one or more other feature(s) disclosed herein, or its (their) equivalent or variant thereof. In any aspect or embodiment of the face protector or system, any one or more feature(s) may be omitted altogether or replaced by another feature, which may be an equivalent or variant thereof.

Modifications and changes to the embodiments described above will be apparent to those skilled in the art.

The invention claimed is:

1. A protective system comprising a helmet having a front and a back, and a face protector for mounting on said helmet and for extending from said helmet towards the front thereof, and comprising a protective portion for extending about a person's mandibular (lower jaw) region, said protective portion comprising a protective structure, said face protector being sized to provide a gap between a front portion thereof and a user's face, when mounted to said helmet, and having a free upper peripheral edge positioned below eye level, when in use, which with said helmet defines a frontal opening between said peripheral edge and a lower front edge of said helmet, wherein said face protector further includes mounting means for mounting a device thereto.

2. A protective system as claimed in claim 1, further comprising mounting means for detachably mounting the face protector to said helmet.

3. A protective system as claimed in claim 2, wherein said mounting means comprises a slidable mounting to enable said face protector to be slideably mounted to said helmet.

4. A protective system as claimed in claim 3, wherein said slideable mounting is oriented to enable said face protector to be slideably moved in a direction extending between the front and back of the helmet.

5. A protective system as claimed in claim 4, further comprising locking means adapted to enable said face protector to be locked relative to said helmet in any one of a plurality of different positions.

6. A protective system as claimed in claim 2, wherein said mounting means comprises a first part and a second part, said second part defining a channel for receiving said first part.

7. A protective system as claimed in claim 6, wherein said channel has an opening formed between said side edges and the ends thereof, said first part includes side edges for engaging corresponding side edges of said channel, and at least one of the side edges of said channel and said first part are formed to prevent the first part being withdrawn through the opening of the channel between the ends thereof.

8. A protective system as claimed in claim 7, wherein said first part comprises a first portion which faces the base of the channel and at least one of the side edges of the first part slopes outwardly towards said first portion.

9. A protective system as claimed in claim 1, wherein said face protector comprises a ballistic resistant or high tensile strength material or structure.

10. A protective system as claimed in claim 1, wherein said face protector includes a scalloped region on at least one lower side portion thereof which extends to a rear edge of the face protector for accommodating a gun, rifle or other shoulder mounted device.

11. A protective system as claimed in claim 1, wherein said mounting means comprises a corresponding mounting provided on said helmet for mounting said face protector thereto, such that said device can be mounted either directly to said helmet using the mounting for the face protector or mounted directly to said face protector using said corresponding mounting.

12. A protective system as claimed in claim 11, wherein said device comprises any one of a light source, a monocular device, glasses, goggles or other optical device.

13. A protective system as claimed in claim 1, wherein said helmet comprises a military combat-type helmet or other casket-type or open face helmet.

* * * * *